US011066834B2

(12) United States Patent
Helms

(10) Patent No.: US 11,066,834 B2
(45) Date of Patent: Jul. 20, 2021

(54) CLADDING

(71) Applicant: GOLDEN HOMES HOLDINGS LIMITED, Hamilton (NZ)

(72) Inventor: Lennard Trevor Helms, Tauranga (NZ)

(73) Assignee: GOLDEN HOMES HOLDINGS LIMITED, Tauranga (NZ)

( * ) Notice: Subject to any disclaimer, the term of this patent is extended or adjusted under 35 U.S.C. 154(b) by 0 days.

(21) Appl. No.: 16/976,032

(22) PCT Filed: Feb. 5, 2019

(86) PCT No.: PCT/NZ2019/050010
§ 371 (c)(1),
(2) Date: Aug. 26, 2020

(87) PCT Pub. No.: WO2019/168412
PCT Pub. Date: Sep. 6, 2019

(65) Prior Publication Data

US 2021/0017771 A1 Jan. 21, 2021

(30) Foreign Application Priority Data

Feb. 28, 2018 (NZ) ..... 740181
Jul. 30, 2018 (NZ) ..... 744733

(51) Int. Cl.
*E04F 13/26* (2006.01)
*E04F 19/06* (2006.01)
(Continued)

(52) U.S. Cl.
CPC ..... *E04F 13/26* (2013.01); *E04F 13/073* (2013.01); *E04F 13/0803* (2013.01);
(Continued)

(58) Field of Classification Search
CPC ..... E04F 13/26; E04F 13/073; E04F 19/06; E04F 13/0803; E04F 19/064;
(Continued)

(56) References Cited

U.S. PATENT DOCUMENTS 2,048,981 A * 7/1936 Vass ..... E04F 19/06 52/355
2,101,612 A * 12/1937 Duffy ..... E04F 19/06 52/468
(Continued)

FOREIGN PATENT DOCUMENTS

CA 2804361 A1 * 1/2012 ..... E04F 13/0898
CA 3005086 A1 * 11/2018 ..... E04F 19/061

OTHER PUBLICATIONS

International Search Report in International Application No. PCT/NZ2019/050010, dated May 10, 2019.
(Continued)

*Primary Examiner* — Phi D A
(74) *Attorney, Agent, or Firm* — Knobbe, Martens, Olson & Bear, LLP

(57) ABSTRACT

An external cladding system includes at least one panel of sheet material, a series of vertically and horizontally oriented panel mounting extrusions, and a number of spaced apart apertures passing through a topmost/bottom most horizontal panel mounting extrusions on a wall. The apertures extend along a longitudinal axis of an internal horizontal portion of the topmost and bottom-most panel mounting extrusions. In use, the at least one panel is held in place on the panel mounting extrusions via: capping extrusions and resilient sealing strips, which are located between the panel and the capping extrusions. One or more spacer
(Continued)

elements are located on the horizontally-oriented panel mounting extrusions, which support the bottom edge of a panel.

9 Claims, 41 Drawing Sheets

(51) Int. Cl.
*E04F 13/073* (2006.01)
*E04F 13/08* (2006.01)
*E06B 1/02* (2006.01)

(52) U.S. Cl.
CPC ..... *E04F 19/06* (2013.01); *E06B 1/02* (2013.01); *E04F 13/081* (2013.01); *E04F 19/064* (2013.01); *E04F 2201/0547* (2013.01)

(58) Field of Classification Search
CPC ... E04F 19/061; E04F 13/081; E04F 13/0862; E04F 13/0898; E04F 13/0805; E04F 2201/0535; E04F 2201/0547; E06B 1/02; E06B 7/28; E06B 3/6621; E06B 3/26; E06B 3/28; E06B 3/2632; E06B 3/9616; E06B 7/2312; E06B 2001/628; E06B 1/68; E06B 1/342; E04B 1/7637; E04B 1/7629; E04B 1/942; E04B 1/40; E04C 2/46
See application file for complete search history.

(56) References Cited

U.S. PATENT DOCUMENTS 2,259,666 A * 10/1941 Small ..... E04F 13/0803 52/474
4,130,972 A * 12/1978 Varlonga ..... E04B 2/7411 52/241
4,164,107 A * 8/1979 Kraemling ..... E06B 3/305 52/232
6,009,683 A 1/2000 Grewe et al.
8,468,767 B1 * 6/2013 McBride ..... E04F 13/0891 52/586.2
10,011,997 B1 * 7/2018 Bilge ..... E04F 13/0733
10,662,698 B1 * 5/2020 Roegge ..... E06B 1/6015
2008/0307726 A1 * 12/2008 Bergman ..... E04F 19/022 52/281
2010/0037549 A1 2/2010 Lynch et al.
2010/0212234 A1 * 8/2010 Monteer ..... E04F 19/06 52/95
2011/0072744 A1 * 3/2011 Maley ..... E04F 19/022 52/220.1
2012/0117901 A1 * 5/2012 Loyd ..... E04F 13/0803 52/235
2012/0317909 A1 * 12/2012 MacKenzie ..... E04B 1/7076 52/288.1
2013/0091800 A1 * 4/2013 Aboukhalil ..... E04F 13/073 52/716.8
2013/0111840 A1 * 5/2013 Bordener ..... E04F 13/0882 52/393
2013/0152498 A1 * 6/2013 Krause ..... E04F 13/0817 52/235
2013/0180202 A1 * 7/2013 Woods ..... E04F 13/26 52/710
2014/0112698 A1 * 4/2014 Ben David ..... E04B 1/40 403/28
2014/0331579 A1 * 11/2014 Evensen ..... E04B 2/96 52/204.593
2014/0345215 A1 * 11/2014 Magoon ..... E06B 3/5427 52/235
2016/0115726 A1 * 4/2016 Hodgson ..... E06B 1/02 52/213
2016/0138273 A1 * 5/2016 Condon ..... B32B 27/32 52/309.14
2017/0020287 A1 * 1/2017 Tremaine ..... A47B 96/1466
2017/0260752 A1 * 9/2017 Bilge ..... E04F 13/0891
2017/0370096 A1 * 12/2017 Ochi ..... E04B 1/7658
2018/0179766 A1 * 6/2018 Tisdall ..... E04B 2/72
2019/0063146 A1 * 2/2019 Freese ..... E04B 2/88
2019/0078375 A1 * 3/2019 McKenna ..... E04B 2/96
2019/0078380 A1 * 3/2019 McKenna ..... E06B 1/40
2019/0376282 A1 * 12/2019 Michel ..... E04B 2/7455
2020/0032576 A1 * 1/2020 Koster ..... E06B 1/02
2020/0224486 A1 * 7/2020 Anderson ..... E06B 3/4609
2020/0240153 A1 * 7/2020 Maziarz ..... E04F 19/061

OTHER PUBLICATIONS

Written Opinion in International Application No. PCT/NZ2019/050010, dated May 10, 2019.

* cited by examiner

CLADDING

TECHNICAL FIELD

The present invention relates to improvements in and relating to cladding. In particular cladding systems and methods for cladding a building.

BACKGROUND ART

Buildings comprising a wooden or steel frame on which pre-formed cladding panels (such as aluminium panels) are mounted to form a non-load bearing exterior facade are known. Such buildings can be erected quickly and more cheaply than brick or block facade buildings.

The Applicant has previously filed and patented a composite cladding building system published as WO2014/098615. The system disclosed in WO2014/098615 offered a number of advantages over prior art cladding systems. The system in WO2014/098615 still however required the use of fasteners during the final stage of affixing the panels to cavity battens. The WO2014/098615 system also utilised composite panels having an insulating layer attached thereto. The advantage of a composite panel being it prevented the panel from rippling due to thermal expansion.

It would be useful if there could be provided a cladding system which did not require fasteners, such as screws, to affix the panels to cavity battens on a building frame. It would also be useful if such a cladding system could at least provide a similar, but preferably an improved weather seal to that of prior art cladding systems such as WO2014/098615.

It would also be useful if there could be provided a cladding system which did not require composite panels. As composite panels can be flammable and present a fire hazard.

It would also be useful if there could be provided a cladding system which could be used on both new builds or as a retrofit over existing cladding (including but limited to: concrete slabs, stucco, bricks, concrete block, aerated concrete block, aerated concrete slabs, weatherboard or wooden or cement paneling or a combination thereof) already in place on a building without the need to remove the existing cladding, windows or doors.

It would also be useful if the cladding system which helped prevent damage to the outer surface panels themselves or coatings applied thereto—such as paint or powder coatings—through expansion and contraction.

It is an object of the invention to provide an alternative to a composite cladding panel system that addresses at least some of the problems of the prior art, such as, but not limited to, those discussed above.

Alternatively, it is an object of the invention to at least provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Further aspects and advantages of the present invention will become apparent from the ensuing description which is given by way of example only.

Definitions

The term 'surround' when used herein in relation to the panels and extrusions of the present invention refers to the extrusions framing and overlapping the edges of a panel to form a border which has an internal and external edge.

The term 'clip' or clipping' as used herein refers to connecting one object (e.g. a first extrusion) to another (e.g. a second extrusion) by pressing or pushing into position.

The term "panel mounting extrusions" includes the following different types of mounting extrusions which help hold the panels:

- internal corner panel mounting extrusions located on side edges of a wall;
- external corner panel mounting extrusions located on side edges of a wall;
- top/bottom panel mounting extrusions located at the topmost or bottommost horizontal edges of a wall;
- vertical panel mounting extrusions located intermediate the top/bottom mounting extrusions defining the upper and lower edges of the wall and positioned in between vertically adjacent pairs of horizontal mounting extrusions;
- horizontal panel mounting extrusions located intermediate the internal/external corner extrusions defining the outer side edges of the wall.

The term "installing" as used herein includes the steps of cutting an extrusion, or other item, to the correct size and/or shape required for installation—as would be clear to a person skilled in the art, or as disclosed herein.

The term "finned joinery" as used herein refers to any window or door joinery frames which has a peripheral fin (flange) on the front of the joinery frame. Finned joinery generally is used on domestic buildings (such as houses) and non-finned joinery is generally used on commercial buildings.

DISCLOSURE OF THE INVENTION

According to a first aspect of the present invention there is provided an external cladding system for a wall of a building which includes:

- at least one panel of sheet material;
- a series of vertically and horizontally oriented panel mounting extrusions, the respective horizontal and vertical panel mounting extrusions being spaced apart a sufficient distance, to in use:
  - underlap with a portion of; and
  - surround;

via at least a receiving portion on said panel mounting extrusion;

at least two edges of a panel;

in use, said panel mounting extrusions affixed to a building frame via cavity battens;

- a plurality of spaced apart apertures passing through a topmost horizontal panel mounting extrusion and a bottom most horizontal panel mounting extrusion on the wall, the apertures extending along a longitudinal axis of an internal horizontal portion of said topmost and bottom most panel mounting extrusions;

wherein, in use, the at least one panel is held in place on said panel mounting extrusions, via a combination of:

capping extrusions which include attachment portions which engage with the receiving portion in the panel mounting extrusions, wherein the capping extrusion also includes a cover section which overlaps with a portion of, and surrounds, at least two edges of the panels; and resilient sealing strips which are located between the panel and the capping extrusions;

one or more spacer elements located on the horizontally oriented panel mounting extrusions which support the bottom edge of a panel, the bottom edge of a panel resting on said spacer element(s);

such a combination enabling the panel to: expand or contract and move with respect to the capping extrusion without any contact therewith.

According to a second aspect of the present invention there is provided an external cladding system substantially as described above wherein the cladding system further includes:

cavity batten extrusions, in use said panel mounting extrusions affixed to a building frame via the cavity batten extrusions;

a support bar extrusion and associated sill cap extrusion for affixing at the bottom of any windows/doors;

top window flashing extrusions for affixing at the top of any windows/doors;

top and bottom mounting extrusions to install over the top window/door flashing.

Preferably, there is an external cladding system substantially as described above wherein one or more said panel mounting extrusions is intergrated as a whole with said cavity batten.

Preferably, there is an external cladding system substantially as described above further comprising spacer extrusions, wherein the horizontal panel mounting extrusions are attached to spaced apart vertical cavity battens, and wherein a said spacer extrusion is attached to vertical cavity battens between adjacent horizontal panel mounting extrusions intermediate vertical edges of the panels, wherein the spacer extrusion bears against an inside surface of the panels.

Preferably, there is an external cladding system substantially as described above wherein the spacer extrusion has the same cross section as the capping extrusion.

Preferably, there is an external cladding system substantially as described above wherein the system further comprises a mounting extrusion in the form of a vertical cavity batten extrusion to be positioned adjacent a window or door frame, wherein the vertical cavity batten extrusion comprises an integral weather flashing.

Preferably, there is a cladding system substantially as described above wherein a said panel mounting extrusion comprises one or more integral weather flashings.

According to a third aspect of the present invention there is provided an external cladding system substantially as described above wherein securement of the panel between the mounting extrusion and capping extrusion takes place without the use of fasteners.

According to a fourth aspect of the present invention there is provided a method of cladding a wall of a building with one or more panels comprising the steps of:

a) affixing a series of vertically and horizontally oriented panel mounting extrusions, spaced apart a sufficient distance, to in use underlap with a portion of, and surround—via at least a receiving portion on said mounting extrusion—at least two edges of a panel; said panel mounting extrusions are affixed to a building frame via cavity battens;

b) placing one or more spacer elements located on the horizontally oriented panel mounting extrusions which support the bottom edge of a panel, the bottom edge of a panel resting on said spacer element(s);

c) securing the panel(s) in place on said extrusions, via a combination of:

capping extrusions which include attachment portions which engage with receiving portions in the panel mounting extrusions wherein the capping elements overlaps with a portion of, and surround, at least two edges of the panels; and resilient sealing strips which are squeezed between the panel and the capping extrusions;

such that the panel can, expand or contract, with respect to the capping extrusion without any contact therewith, wherein the uppermost and lowermost horizontally oriented panel mounting extrusions on the wall associated with a level of the building are configured to allow air to pass from the exterior to the interior of the panels.

According to a fifth aspect of the present invention there is provided an external corner panel mounting extrusion having a cross sectional profile which includes:

two connected flanges forming an angled portion for attachment to a stud on an external corner of a wall;

a polygon section portion (PSP) which extends out from intersection of the two flanges;

a receiving portion which is located on an external corner of the PSP-diagonally opposite the intersection of the two flanges;

wherein the channel portion extends from said corner of the PSP.

According to a sixth aspect of the present invention there is provided an external mounting extrusion substantially as described above wherein the receiving portion is angled with respect to said corner portion.

According to a seventh aspect of the present invention there is provided an external mounting extrusion substantially as described above wherein said receiving portion is angled at substantially 45 degrees.

According to an eighth aspect of the present invention there is provided an internal corner mounting extrusion having a cross sectional profile which includes:

an angled portion (AP)—formed from two connected polygonal sections—for attachment to the two studs forming an internal corner of a wall;

a receiving portion which is located on or near the internal intersection of the two connected polygonal sections of the AP.

Preferably, the polygonal sections are connected to form a right angle. However, they may be connected to form other angles which conform with the angle of the internal corner.

According to a ninth aspect there is provided an internal corner mounting extrusion substantially as described above wherein the receiving portion is angled with respect to the internal intersection of the connected polygonal sections of the AP.

According to a $10^{th}$ aspect of the present invention there is provided an internal mounting extrusion substantially as described above wherein the polygonal sections are connected to form a right angle and wherein said receiving portion is angled at substantially 45 degrees.

According to a 11$^{th}$ aspect there is provided a kit of parts for cladding the exterior of a building with panels comprising:

vertically and horizontally oriented panel mounting extrusions;

cavity battens;

spacer elements;

capping extrusions;

at least one panel of sheet material;

at least one length of resilient sealing strip.

According to an 12$^{th}$ aspect there is provided a cladding system including:

a panel of sheet material;

panel mounting extrusions which surround the periphery of the panel and include receiving portions positioned adjacent the outside edge of the periphery of the panel, said panel mounting extrusions being affixed to a building frame via cavity battens;

capping extrusions which clip into the receiving portions of the panel mounting extrusions;

wherein the panel is held in place, without fixing elements, by the capping extrusions via a resilient strip which is sandwiched between the panel and the capping extrusion; wherein the bottom edge of each panel rests on at least one spacer element on the panel mounting extrusion which receives the bottom edge of the panel.

According to a 13$^{th}$ aspect of the present invention there is provided a method of cladding a building comprising the step of securing cladding panels in place upon a building frame, without the use of fasteners, to hold the panels in place, the panels being secured via a combination of:

a) panel mounting extrusions affixed to the framework so as to surround the edges of panels, which will in use, clad said framework; and b) clipping capping extrusions which surround and overlap the edge portions of the cladding panels into said mounting extrusions;

the panels further being securely held in place with resilient sealing strips which are pressed in between the panel and the capping extrusions the panel resting one or more spacer blocks.

According to a 14$^{th}$ aspect of the present invention there is provided method of cladding a building substantially as described above wherein the method is adapted to provide a retrofit to an existing building wherein the method comprises the additional steps of:

i) Installing vertical/top transition base extrusions to both sides of the window or doors using adhesive;

ii) Installing vertical/top transition base extrusion to a top of window/door using adhesive;

iii) Installing horizontal sill transition base extrusion to bottom of window/door using adhesive.

According to a 15$^{th}$ aspect of the present invention there is provided a transition base extrusion having a cross-sectional profile which includes:

an angled portion formed from two connected planar sections;

wherein one planar section has a width which is at least substantially twice that of the other planar section; and wherein the planar section having the longest width includes a plurality of spaced apart ribs projecting from the inner surface thereof.

Preferably, in one preferred embodiment the transition base extrusion has the planar sections connected to form a right angle.

Preferably, in another preferred embodiment the transition base extrusion has the planar sections connected to form an angle of substantially 105 degrees.

According to a 16$^{th}$ aspect there is provided a top and bottom mounting extrusion which includes:

a base portion having a planar surface for attachment to a building frame;

a projecting portion from the base portion which includes a plurality of spaced apart apertures passing through the projecting portion the apertures extending along a longitudinal axis of said projecting portion;

a receiving portion which is located at the distal end of said projecting portion for attaching a capping extrusion;

a panel-receiving (PR) portion which is also located at the distal end of the projecting portion.

According to a 17$^{th}$ aspect of the present invention there is provided a stack joint flashing extrusion which includes:

a base portion having a planar surface for attachment to a building frame;

a cover portion which extends laterally out from the base portion which includes a top section and a downwardly depending front section;

wherein the base portion includes a tab at the top end thereof which projects up above the top section of the cover portion.

Preferably, there is provided a stack joint flashing extrusion substantially as described above wherein the tab includes a longitudinally extending groove or depression on the outer facing surface thereof.

According to an 18$^{th}$ aspect of the present invention there is provided a method of cladding a building substantially as described above wherein the building will comprise two or more levels, including a high-rise building, wherein the method is adapted to provide a joint between levels, the method comprising the additional steps of:

installing a stack joint flashing extrusion to abut and overlap the uppermost portion of a top/bottom mounting extrusion mounted on the top of a lower level wall;

installing a top/bottom mounting extrusion to abut and overlap a tab on the stack joint flashing extrusion;

installing capping extrusions onto the respective top/bottom mounting extrusions.

According to a 19$^{th}$ aspect there is provided a window/door—batten receiver (WDBR) flashing extrusion which includes when view end on:

a vertical section;

a downwardly sloped section extending outwardly from the lower end of the vertical section;

a lip portion;

wherein the vertical section includes a panel-receiving (PR) portion on the surface from which the downwardly sloped section projects;

wherein the PR portion includes a resilient sealing strip (RSS) retaining portion thereon.

According to a 20$^{th}$ aspect there is provided a transition batten (TB) panel-batten extrusion which includes when view end on:

a polygonal cavity batten portion having outward facing surface which is vertical or vertically inclined;

a downwardly sloped planar section extending from a lower region of the outward facing surface;

a panel-receiving (PR) portion at a distal end of the downwardly sloped section.

According to a 21$^{st}$ aspect there is provided a transition batten (TB) extrusion which includes when viewed end on:

a polygonal cavity batten portion having an outward surface which includes a receiving portion thereon;

a fixing face positioned out from one side of the batten via a projecting arm, wherein said fixing face has at:

a lower distal end an outer transition face extending therefrom; and an upper distal end an inner transition face extending therefrom;

wherein:

the outer transition face includes a fold back portion which runs parallel to said outer transition face a distance sufficient to receive, in use a resilient sealing member, said fold back portion ending in a lipped projection against which the resilient sealing member can abut; and wherein the inner transition face, in use, abuts a rigid underlay or flexible building wrap, the fixing face extending a distance sufficient to enable the inner transition face to align the transition batten extrusion so as to be parallel with exterior of the building.

According to a 22$^{nd}$ aspect of the present invention there is provided a method of cladding a building substantially as described above wherein the building will comprise two or more levels, including a high-rise building, wherein the method is adapted to provide a stack joint between levels, the method comprising the additional steps of:

installing a top/bottom mounting extrusion on the top of a lower level wall;

installing a window/door batten receiver (WDBR) flashing extrusion on the bottom of an upper level wall, the WDBR flashing extrusion having a transition batten (TB) panel-batten extrusion clipped thereto.

BRIEF DESCRIPTION OF THE DRAWINGS

Further aspects of the present invention will become apparent from the ensuing description which is given by way of example only and with reference to the accompanying drawings in which:

In FIG. 1B the frame of FIG. 1A is covered with a rigid air barrier;

BEST MODES FOR CARRYING OUT THE INVENTION

Statement of Corresponding Applications

This application is based on the Provisional specifications filed in relation to New Zealand Patent Application Numbers 740181 and 744733, the entire contents of which are incorporated herein by reference.

In relation to the FIGS. 1-42 there are shown a number of different extrusions utilised in the method of the present invention which is detailed below. Like numbers have been used for like elements shown in the Figures.

Figure 1A:
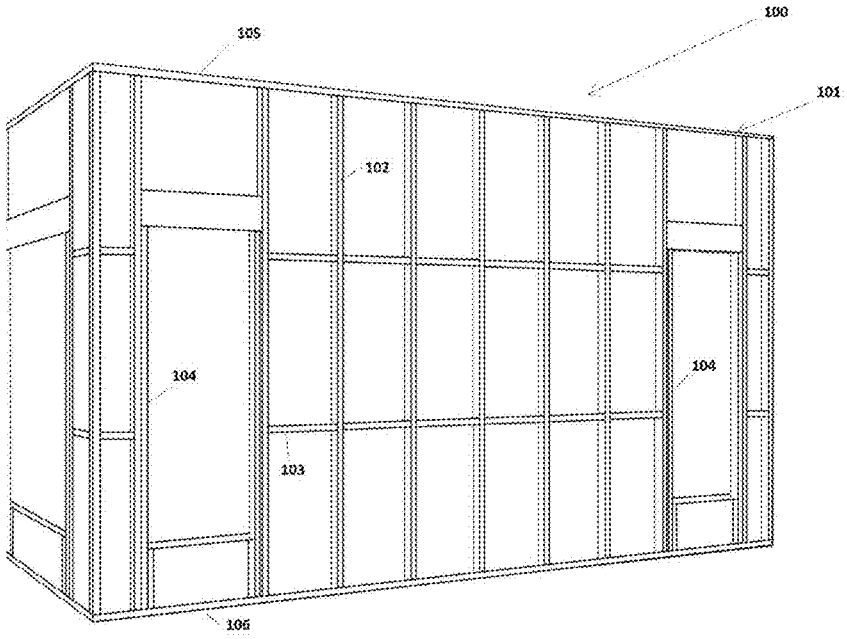
FIGS. 1A and 1B FIG. 1A shows a wall to which exterior cladding is to be applied comprising a building frame having studs spanning between ceiling and sole plates.
Figure 1B:
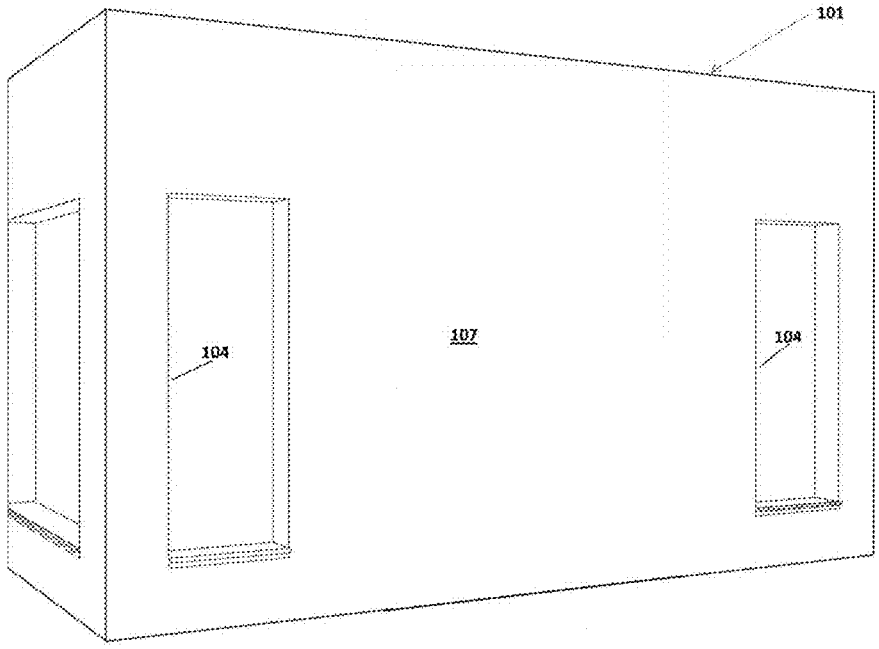
Figure 2:
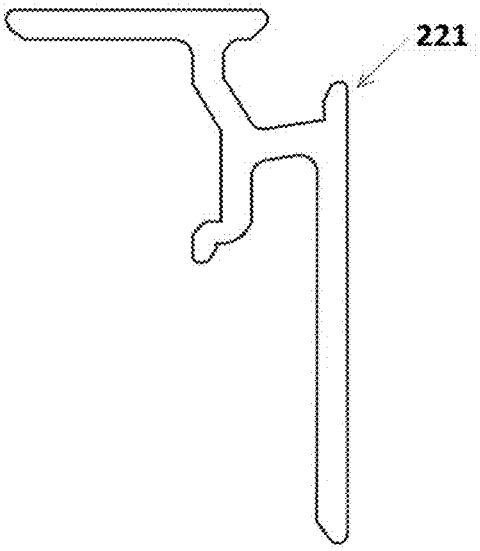
FIG. 2 shows an end-on view of a prior art WANZ bar utilized in a preferred embodiment of the present invention.
Figure 3:
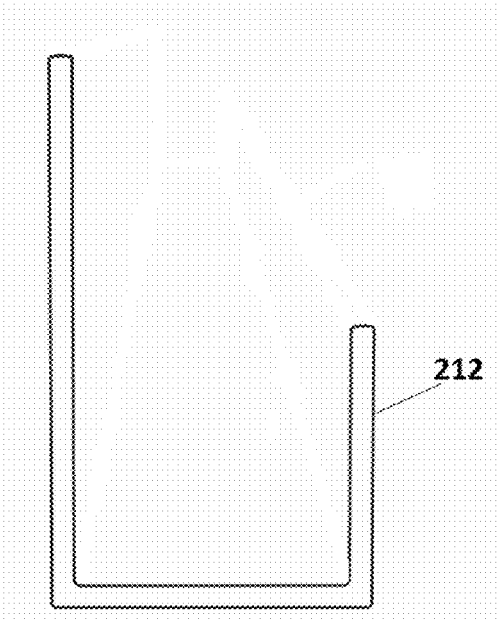
FIG. 3 shows an end-on view of a prior art sill cap utilized in a preferred embodiment of the present invention.
Figure 4:
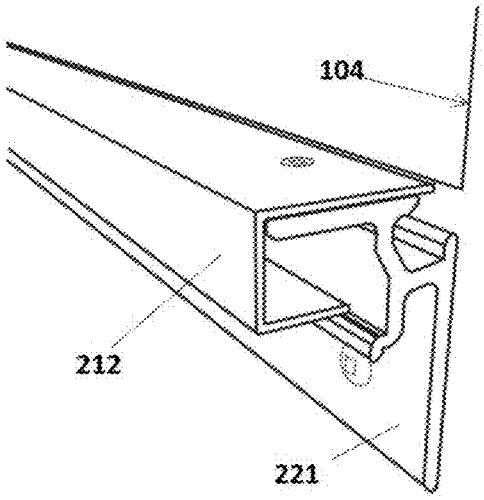
FIG. 4 shows a close-up view of the sill cap installed on the WANZ bar which is to be installed on the bottom of the windows.

Example 1—Cladding System for New Builds Using Finned Joinery for Windows and Doors FIG. 1A shows a portion of a building 100 which is part of new build. The building 100 has an exterior wall 101 consisting of a building-frame comprising studs 102 and optional dwangs 103 window aperture frames_104 and a ceiling (top) plate 105 and sole (bottom) plate 106. FIG. 1B shows the wall 101 covered with a rigid air barrier (aka rigid underlay) such as sealed cement sheets 107. An alternative to a rigid air barrier is flexible building wrap. However, it should be appreciated whilst building paper could be used instead of a rigid air barrier or flexible building wrap this is less preferred.

Figure 5:
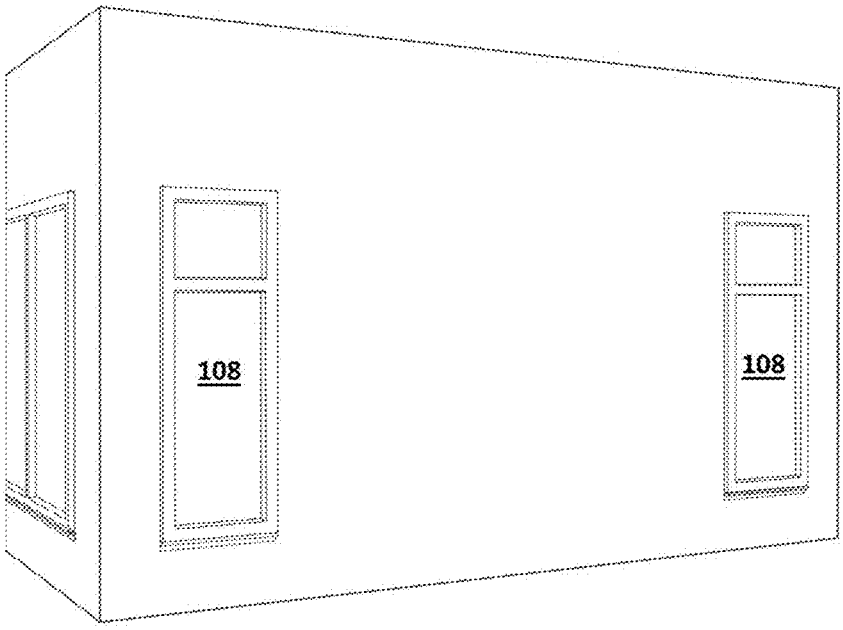
FIG. 5 shows the wall of FIG. 1 once windows have been installed.
Figure 15:
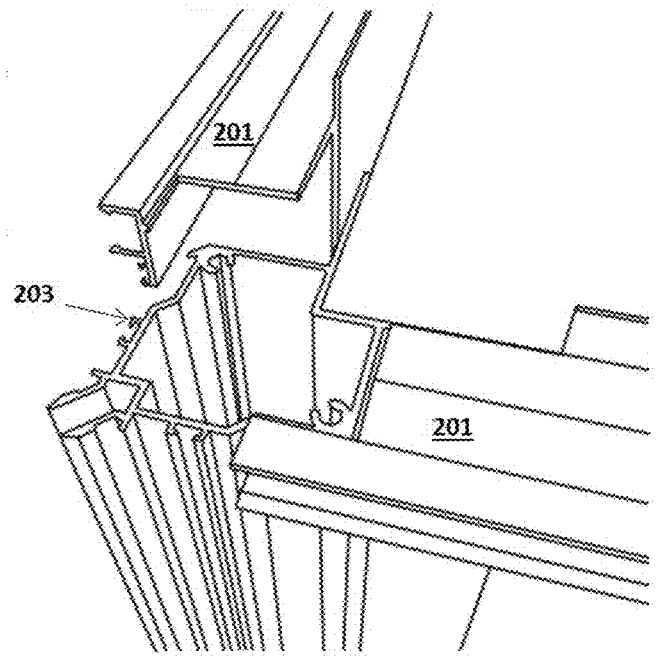
FIG. 15 shows a close-up of top and bottom mounting extrusions which have been cut to fit an external corner mounting extrusion.
Figure 16:
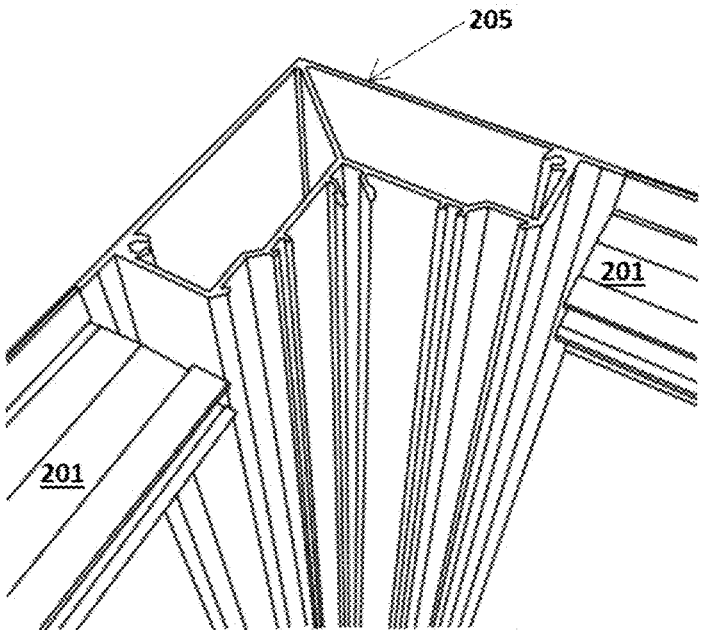
FIG. 16 shows a close-up of top and bottom mounting extrusions which have been cut to fit an internal corner mounting extrusion in accordance with one preferred embodiment of the present invention.
Figure 17:
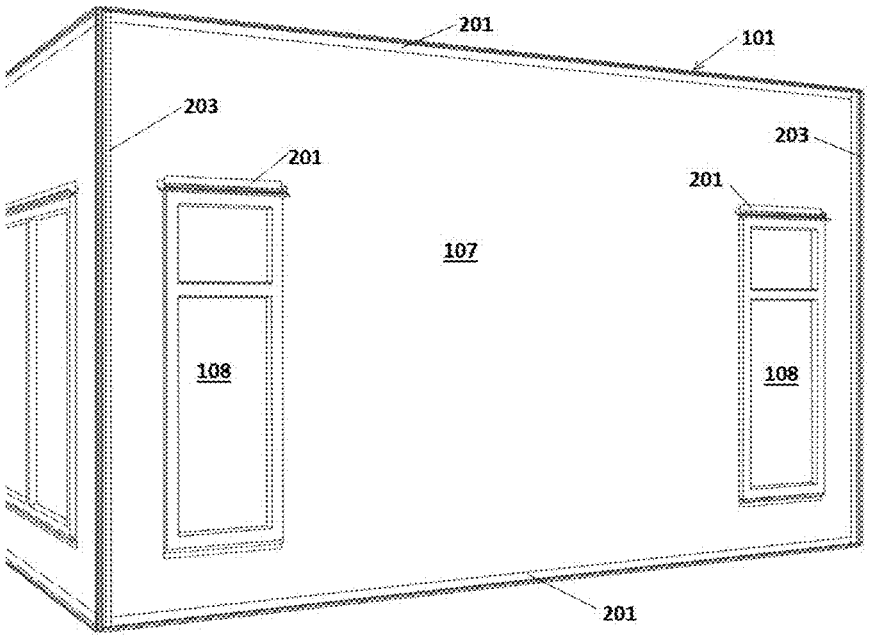
FIG. 17 shows the wall of FIG. 1 once the top and bottom mounting extrusions have been installed.
Figure 18:
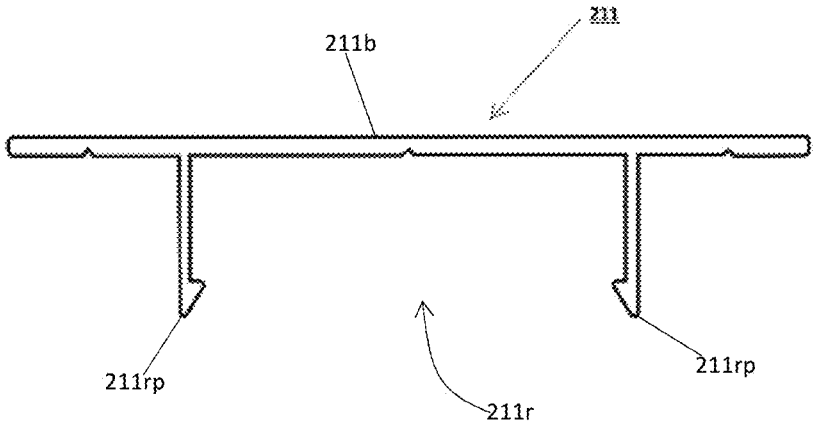
FIG. 18 shows an end-on view of a vertical base extrusion in accordance with one preferred embodiment of the present invention.
Figure 19:
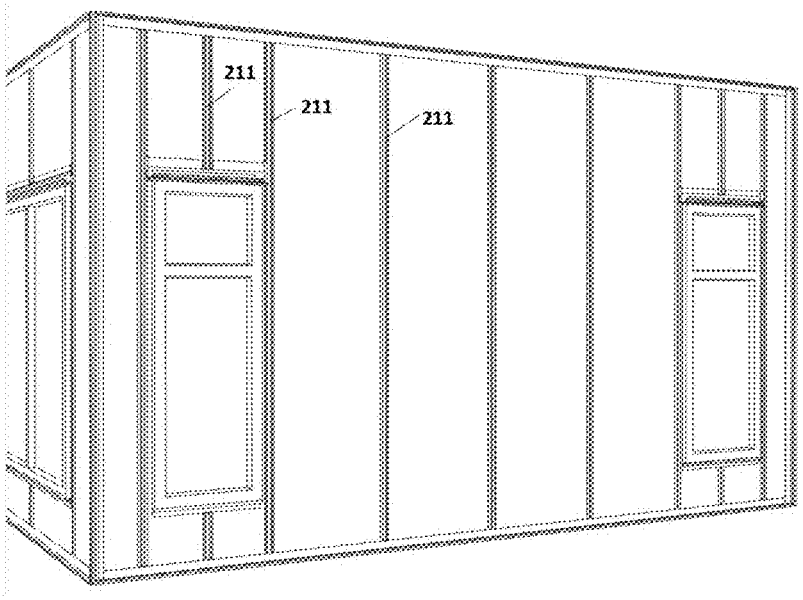
FIG. 19 shows the wall of FIG. 1 with vertical base extrusions installed next to windows.
Figure 20:
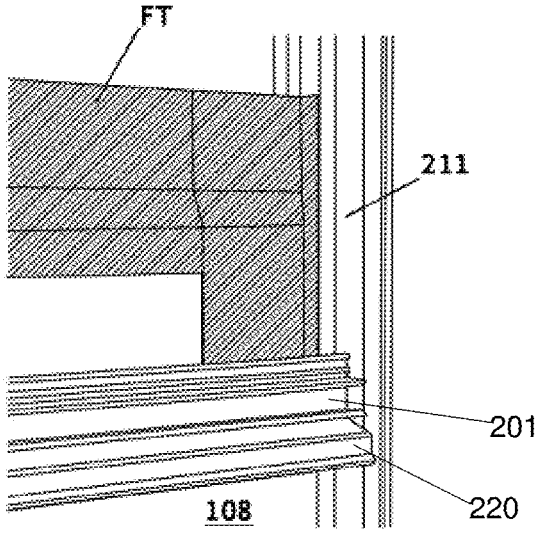
FIG. 20 shows a close-up of weather flashing tape installed on top mounting extrusions located above windows.
Figure 24:
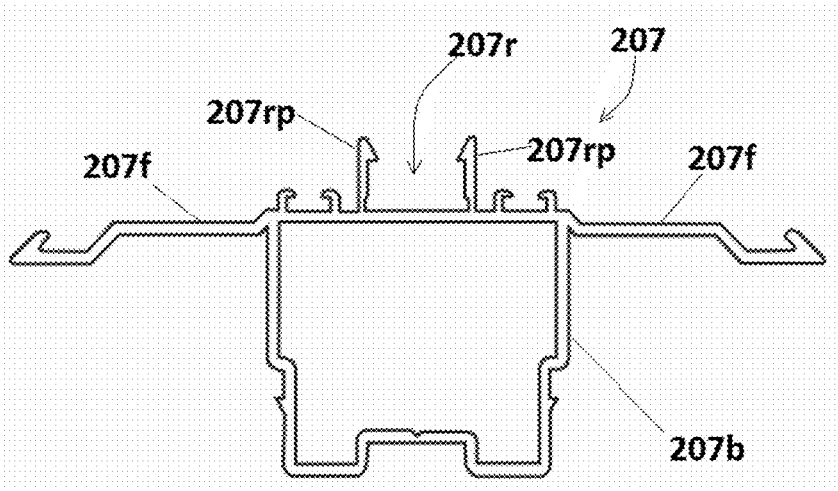
FIG. 24 shows an end-on view of a vertical mounting extrusion in accordance with one preferred embodiment of the present invention.
Figure 25:
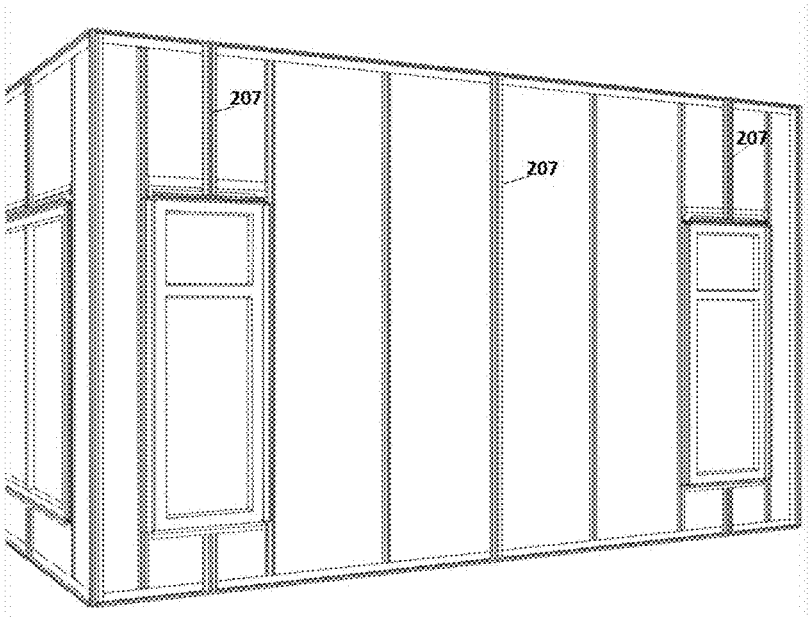
FIG. 25 shows the wall of FIG. 1 with the vertical mounting extrusions installed.
Figure 26:
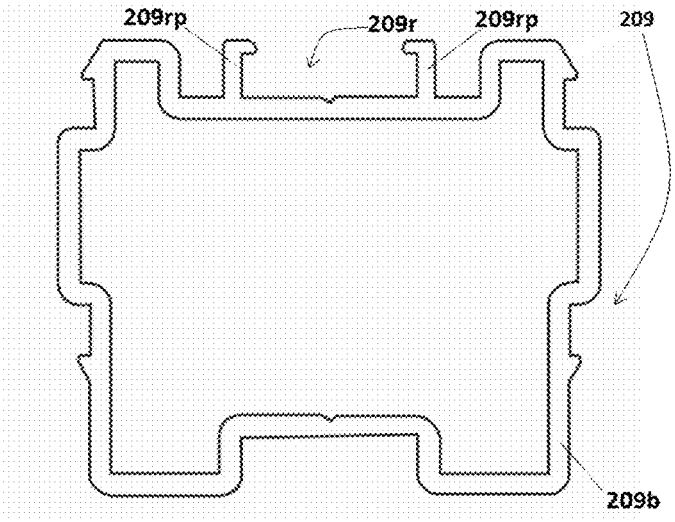
FIG. 26 shows an end-on view of a cavity batten in accordance with one preferred embodiment of the present invention.
Figure 27:
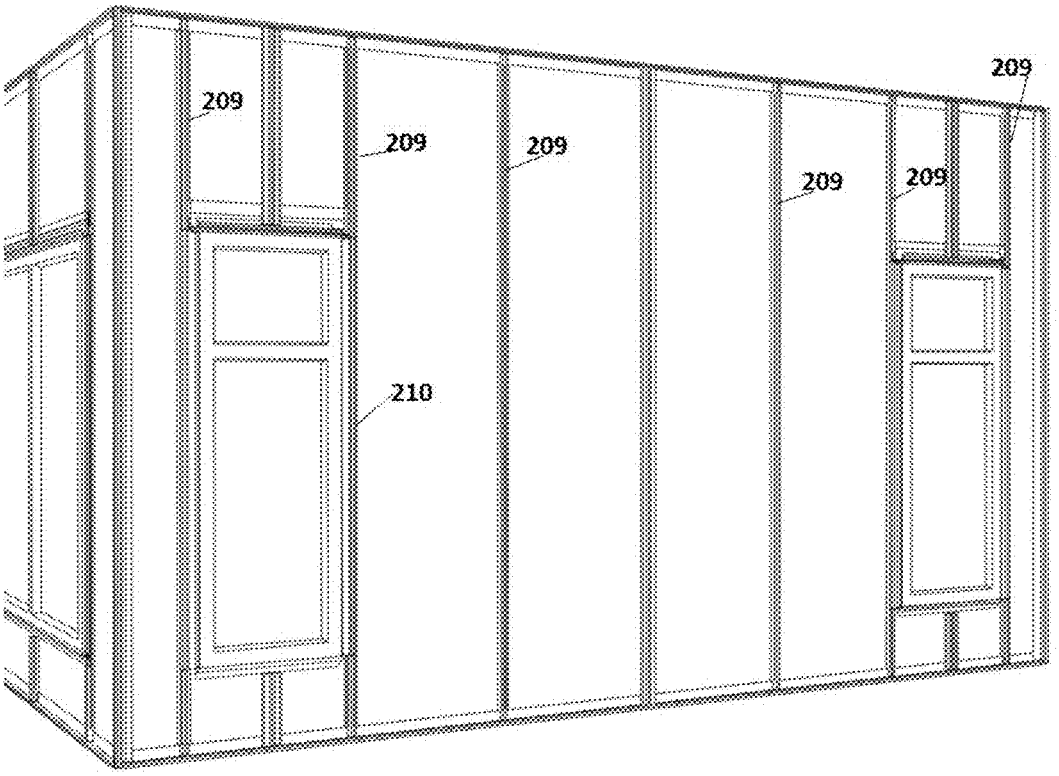
FIG. 27 shows the wall of FIG. 1 with the cavity battens clipped into the vertical mounting extrusions located at the mid panel intervals and above the window/door battens.
Figure 28:
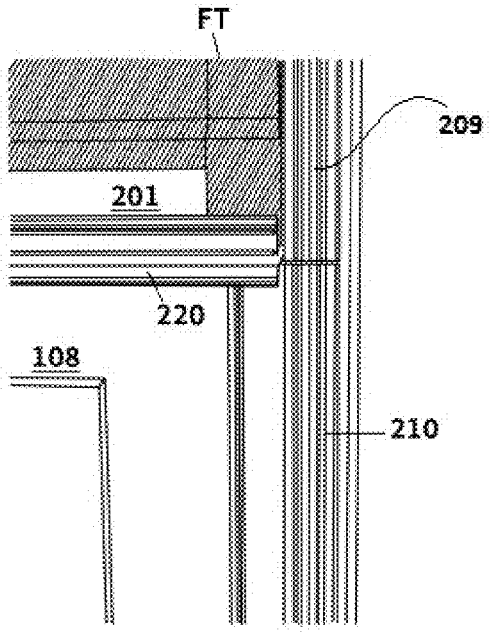
FIG. 28 shows a close-up of the door/window mounting extrusions next to the windows and cavity battens extending up above the door/window mounting extrusions.
Figure 29:
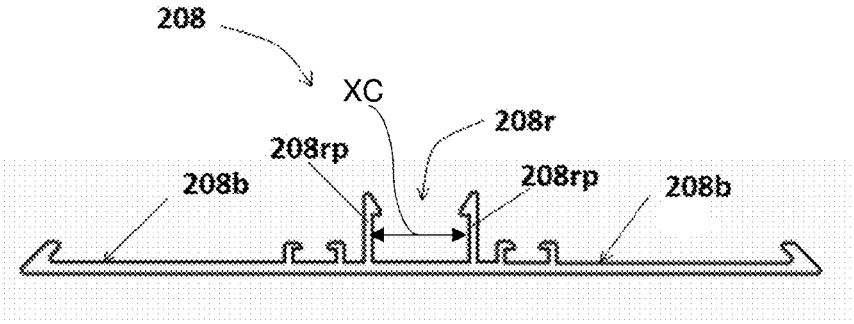
FIG. 29 shows a horizontal mounting extrusion in accordance with one preferred embodiment of the present invention.
Figure 30:
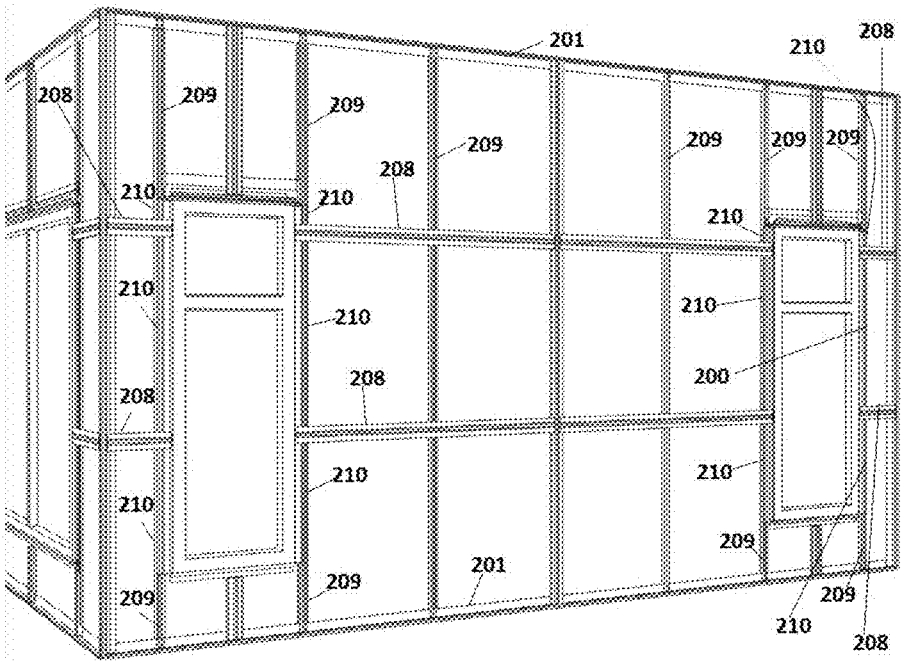
FIG. 30 shows the wall of FIG. 1 with the horizontal mounting extrusions installed thereon.
Figure 31:
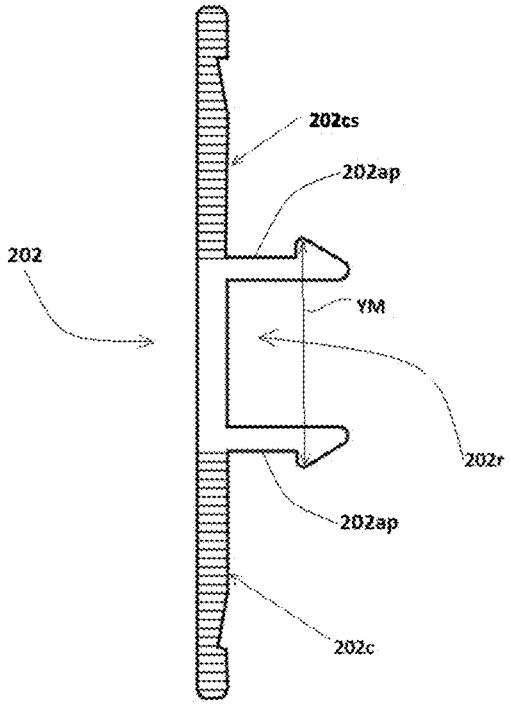
FIG. 31 shows a capping extrusion in accordance with one preferred embodiment of the present invention.
Figure 32:
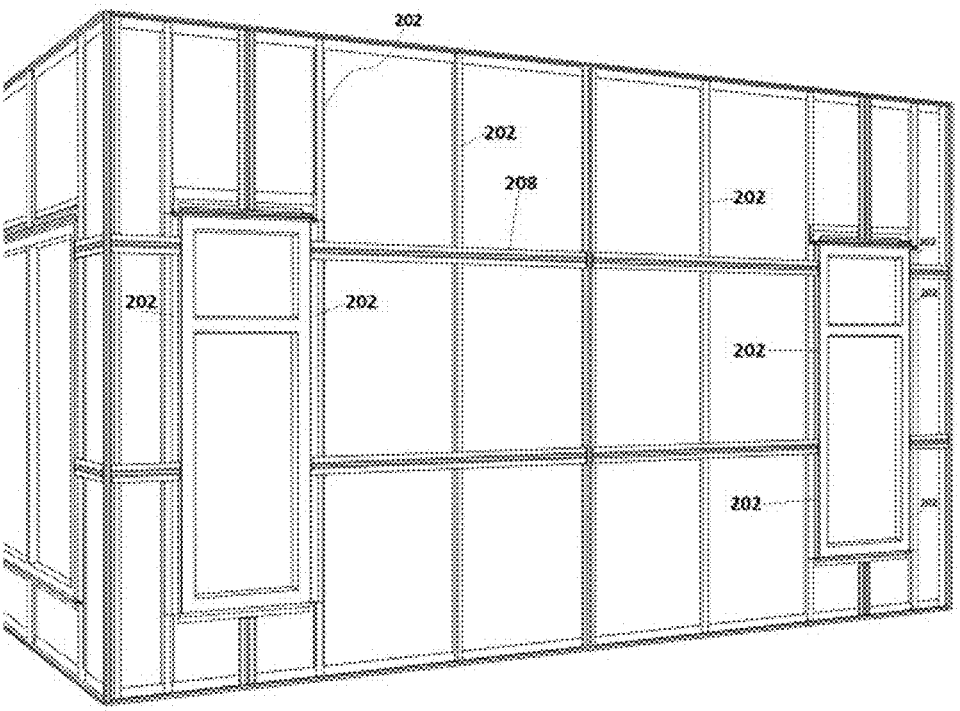
FIG. 32 shows the wall of FIG. 1 with the capping extrusions clipped on to the door/window mounting extrusions and clipped into the cavity battens of FIG. 27.
Figure 33:
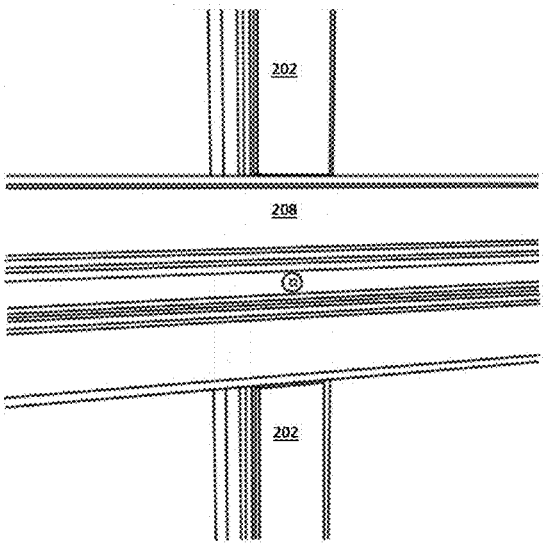
FIG. 33 shows a close-up of how the capping extrusions are cut to fit in between the horizontal cavity battens.
Figure 34:
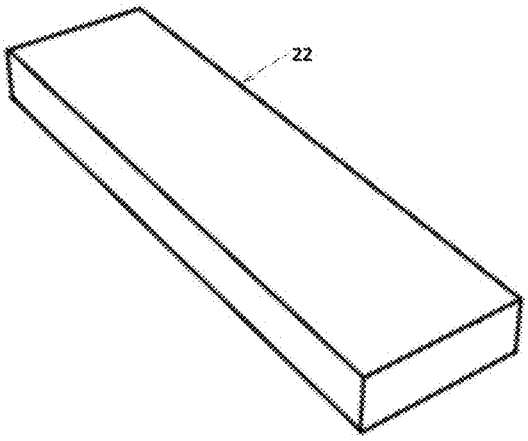
FIG. 34 shows a close-up of spacer blocks in accordance with one preferred embodiment of the present invention.
Figure 35:
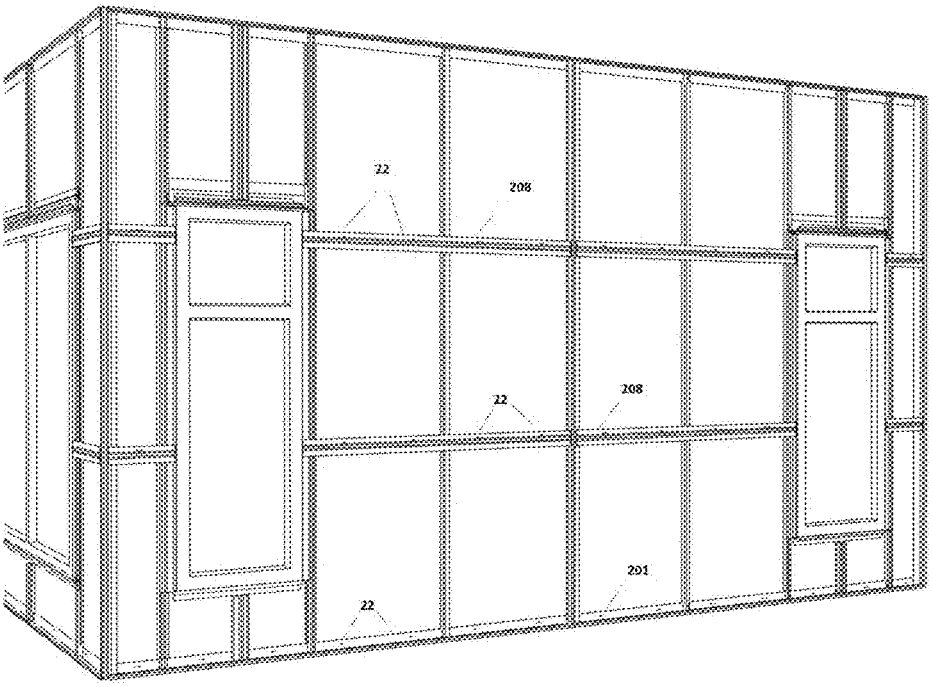
FIG. 35 shows the wall of FIG. 1 with spacer blocks installed on the horizonal mounting extrusions so as to in use support the bottom edge of panels.
Figure 36:
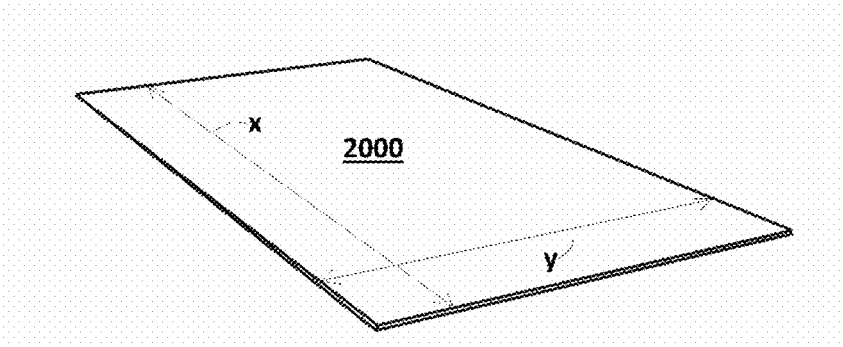
FIG. 36 shows the panel to be placed on the wall shown in FIG. 37.
Figure 38:
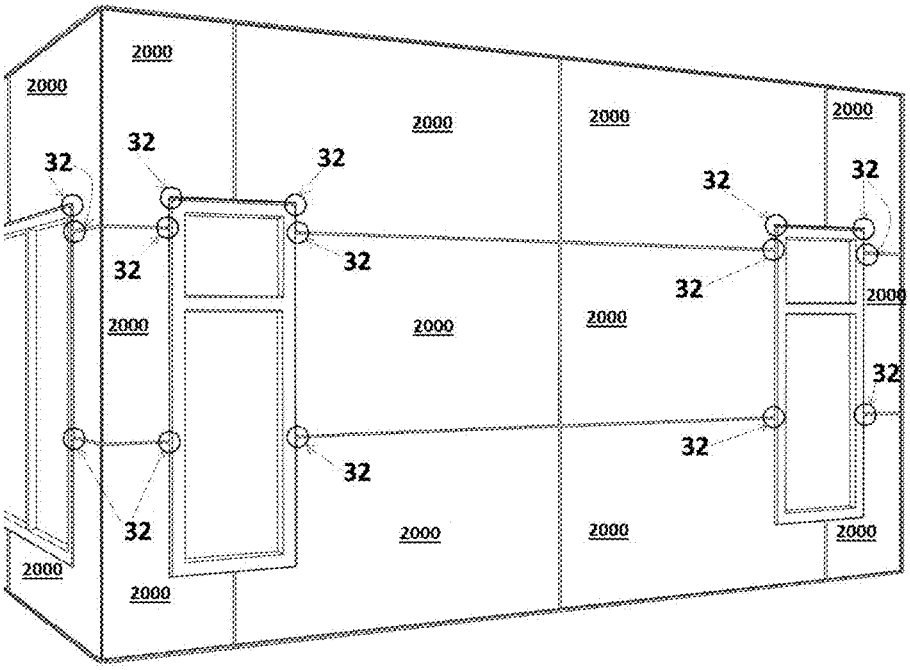
FIG. 38 shows the wall as shown in FIG. 1 which has all the panels placed thereon to cover the exterior of the wall.
Figure 39:
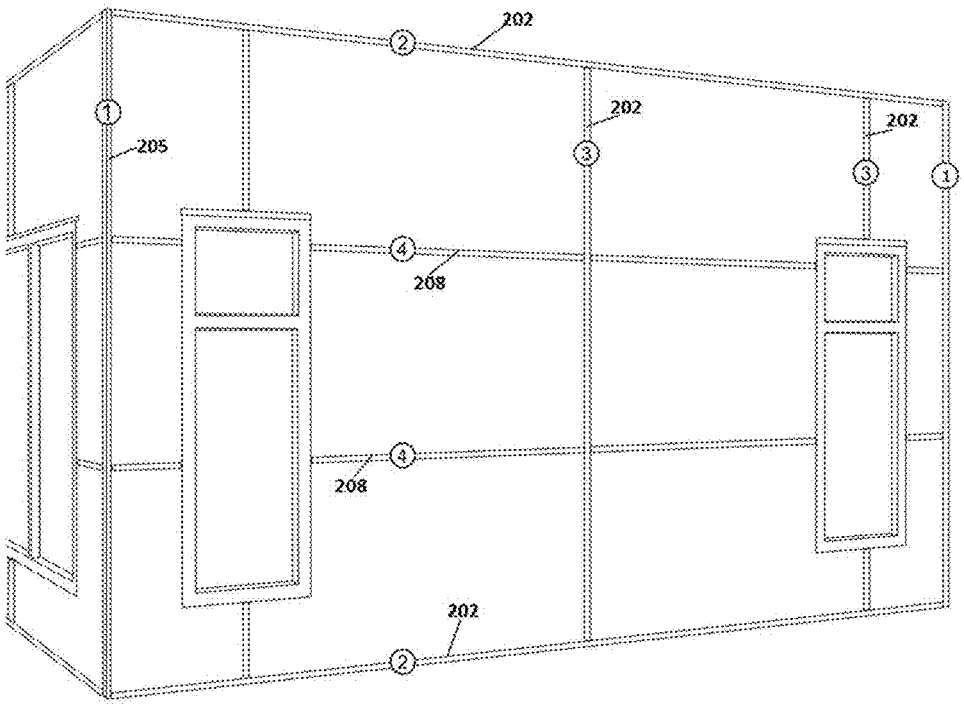
FIG. 39 shows the wall as shown in FIG. 38 and indicates the order in which the capping extrusions are fitted to the horizontal and vertical mounting extrusions to mount the panels once put in place as indicated by FIG. 37.
Figure 40:
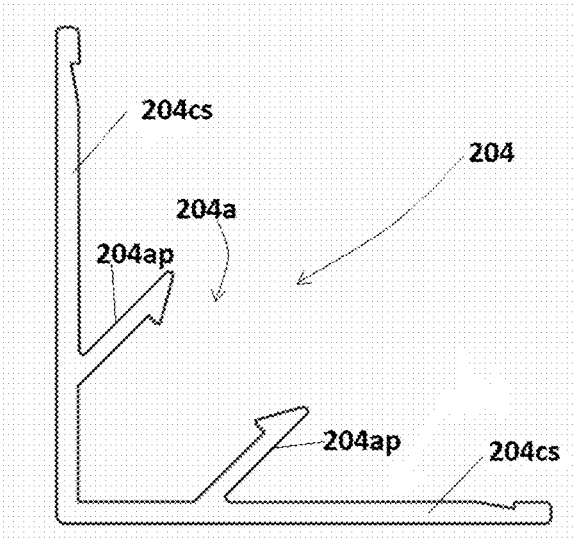
FIG. 40 shows an external corner capping extrusion in accordance with one preferred embodiment of the present invention.
Figure 41:
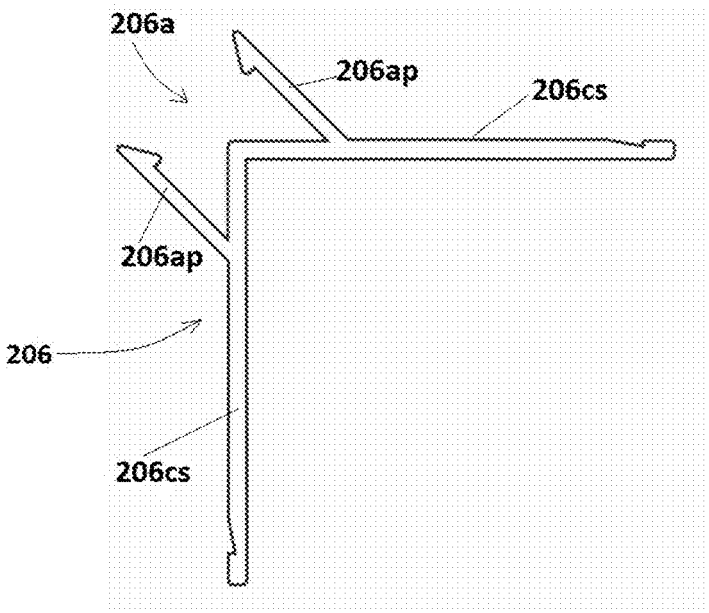
FIG. 41 shows an internal corner capping extrusion in accordance with one preferred embodiment of the present invention.
Figure 42:
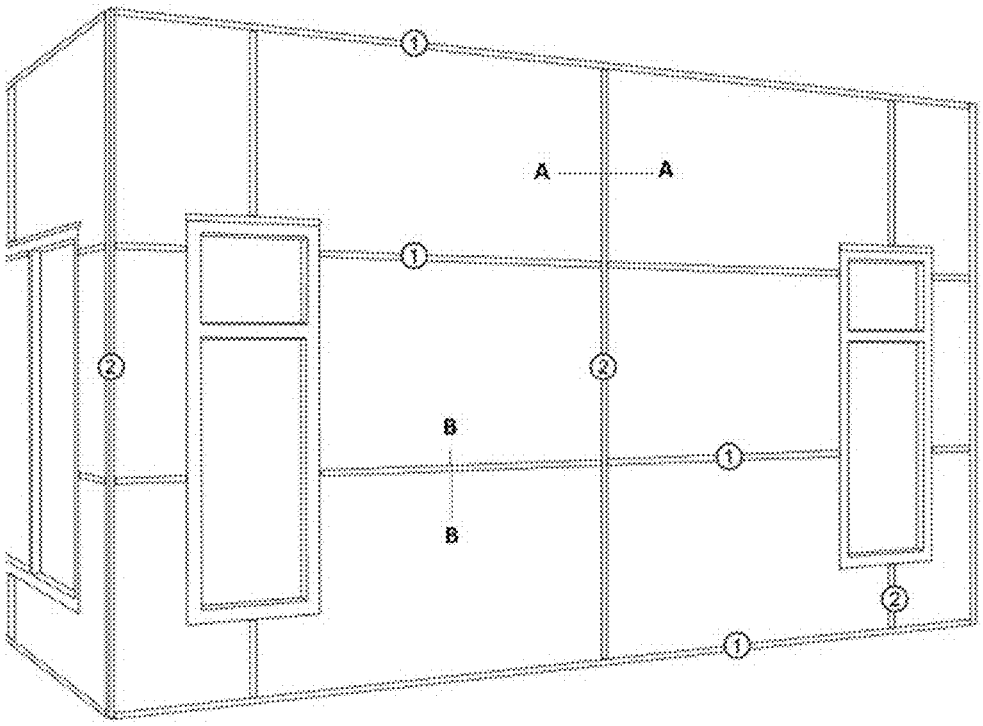
FIG. 42 shows the wall as shown in FIG. 39 and indicates the order in which the resilient strip is to be fitted to the edges of each of the panels.

The Figures will now all be described in relation to one preferred method of cladding an exterior wall of a new build with rectangular pre-painted aluminium panels, the method comprising the steps of:

a) Affixing a support bar (WANZ bar) 221 with screws to the bottom of all window (or door) aperture frames 104 and attaching a sill cap 212 thereto via screws;—refer FIGS. 1-4. The top edge of panels that will eventually be positioned under the window abut against the vertical surface of 212 and slide behind the back of the window/door fin.

b) Installing windows 108 (and doors if any) into the window frame apertures 104 onto the sill cap 212 with an overhang creating 42 mm gap between the rigid air barrier 107 and the back of the window fin (or door fin).—refer FIG. 5. The front edge of the window aperture frames overhangs the front (outer surface) of the rigid air barrier 107 by 5 mm and thus are spaced 37 mm from the back of the window fin. This 5 mm gap will subsequently enable a top edge of a panel to be slid in behind the fin and for a resilient sealing strip to be sandwiched between the panel and the fin.

c) Installing flashing 220 (cut to size) on top of windows 108 (and doors (not shown)) and affixing a top and bottom mounting extrusion 201 (which has been cut to size) with screws over the flashing;—refer FIGS. 6,7,8 and 12.

d) Installing bottom plate 218 to the bottom of an external panel corner mounting extrusion 203. If there is an internal corner then install bottom plate 219 to internal corner panel mounting extrusion 205);—refer FIGS. 9,10, 11, 13 and 14.

e) Installing external corner panel mounting extrusion 203 with screws at 450 mm centres to the external corner edges of the wall 101. If there are any internal corners internal corner panel mounting extrusions 205 would be installed also; refer FIG. 12.

f) Cutting top and bottom panel mounting extrusions 201 to fit into the external corner panel mounting extrusion 203 (and if required fitting top and bottom panel mounting extrusions 201 to internal corner panel mounting extrusion 205;—refer FIGS. 15 and 16.

g) Installing top and bottom panel mounting extrusions 201 via screws to:

the ceiling plate (not shown) and sole plate (not shown) of the wall; and above windows/doors;—refer FIG. 17 h) Installing vertical base extrusions 211—via screws (at 450 mm centres and where required)—next to windows 103 and door(s), and at mid-panel intervals, and also wherever vertical panel joins will be required;—refer FIGS. 18 and 19 i) Cutting and placing weather flashing tape (FT) depicted with diagonal hatching to the top and side edges of the top panel mounting extrusions 201 above windows and doors so as to extend around and seal the edges thereof and cover the side of vertical base extrusion 211 adjacent the side edges of the top panel mounting extrusions 201;—refer FIG. 20. For example, the tape may be 3M 8067 All Weather Flashing tape.

j) Clipping door/window cavity battens 210 into vertical base extrusions 211 adjacent windows 108 and doors, such that the flashing 210*f* on door/window cavity batten 210 goes behind the aluminium frame 108*f* and the rearwardly directed fin 108*fi* thereon (not shown) of the window 108;—refer FIGS. 21, 22 and 23, 28.

k) Clipping vertical panel mounting extrusions 207 which include an integral cavity batten into the vertical base extrusions 211 where vertical panel joins will be required;—refer FIGS. 24 and 25. Top and bottom ends of the panel mounting extrusions 207 may overlap the base 201*b* of the top and bottom horizontal panel mounting extrusions 201, as shown in FIG. 25.

l) Clipping cavity battens 209 into vertical base extrusions 211 at mid-panel intervals;—refer FIGS. 26, 27. Top and bottom ends of the cavity battens 209 overlap the base 201*b* of the top and bottom horizontal panel mounting extrusions 201, as shown in FIG. 27.

m) Installing horizontal panel mounting extrusions 208—via screws—to cavity battens 209,210, to span between vertical panel mounting extrusions 208;—refer FIGS. 29 and 30. The horizontal panel mounting extrusions overlap a weather flashing 207*f* of the vertical panel mounting extrusions 207, as shown in FIG. 30.

n) Clipping capping extrusions 202 to door/window batten extrusions 210 to form a base support that spans between horizontal panel mounting extrusions 208;—FIGS. 31 and 32. Clipping capping extrusions 202 to vertical batten extrusions 209 aligned with the door/window extrusions 210 above and below doors/windows. A length of capping extrusion 202 is clipped to the aligned batten extrusion 209 which is aligned with the door/window batten extrusion 210.

o) Clipping capping-extrusions 202 to vertical batten extrusions 209 at mid panel intervals to span between horizontal panel mounting extrusions 208 and forming a panel_base support and top and bottom mounting extrusions 201, FIG. 33.

p) Inserting spacer elements 22 in the form of blocks on top of the horizontal panel mounting extrusions 201,208 so they can in use support the base of the panels; FIGS. 34 and 35.

q) Applying adhesive (not shown) onto capping-extrusions 202 which form a panel base support and will be located intermediate vertical edges of panels and preferably in the vertical mid-line of the panels 2000 during installation before you fit panels. The dashed lines in FIG. 37 indicate panel placement and capping extrusion 202 (on the vertical mid-line) onto which the adhesive is placed. Note adhesive is not to be applied around windows and doors to the capping extrusions 202 clipped to the batten extrusion 210. It is to be noted the height and width of panels 2000 are cut to be 3 mm less than the distance between adjacent vertical panel mounting extrusions and adjacent horizontal panel mounting extrusions. For example, the Adhesive may be Quilosa FMS Adhesive;—FIGS. 36 and 37.

r) Once panels have been fitted applying adhesive at the points indicated by arrows 32 to fill in any visible gaps where panel 2000 meets the edge of window or doors;—FIG. 38.

s) Clipping external corner capping extrusion 204 to external corner extrusion 203 (and if required clipping internal corner capping extrusion 206 (not shown) to internal corner extrusion 205 (not shown)) as indicated by reference numeral 1;—refer FIGS. 39, 40 and 41.

t) Clipping capping extrusion 202 to top and bottom panel mounting extrusions 201 as indicated by reference numeral 2;—refer FIG. 39 u) Clipping capping extrusion 202 to vertical panel mounting extrusion 207 as indicated by reference numeral 3;—refer FIG. 39.

v) Clipping capping extrusion 202 to horizontal panel mounting extrusion 208 as indicated by reference numeral 4;—refer FIG. 39.

w) Inserting a resilient sealing strip 2200 (shown in FIGS. 43 and 44) e.g. a strip of Santoprene™ thermoplastic elastomer under the capping extrusions in the sequence of horizontal capping extrusions first; followed by vertical capping extrusions second; as indicated by reference numerals 1 and 2 in FIG. 42. The insertion of the sealing strip may be facilitated by the use of a glazing roller (not shown).

Figure 7A:
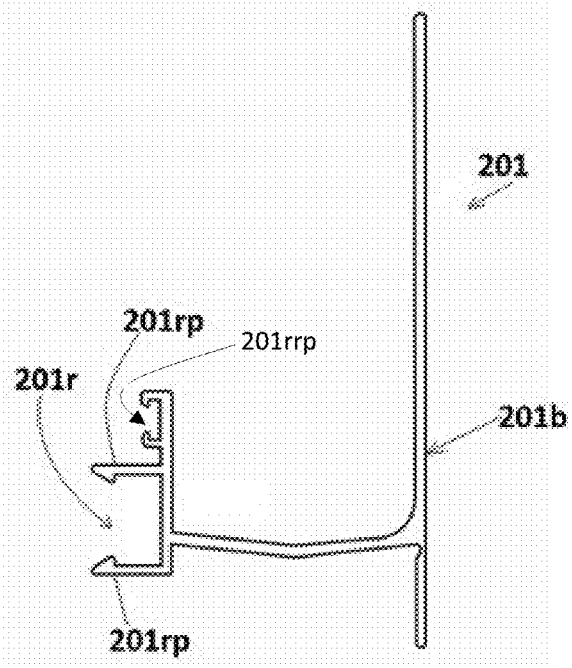
FIGS. 7A & 7B show an end-on view and a bottom view respectively of a top and bottom mounting extrusion in accordance with one preferred embodiment of the present invention.

FIG. 7A shows an end on view of a top and bottom panel mounting extrusion 201 which has a base portion 201*b*, a receiving portion 201*r* and a resilient sealing strip retaining portion 201*rrp*. The base portion 201*b* is fastened to the building frame with screws not shown. The receiving portion is made up of two spaced apart projections 201*rp*. Connecting the base portion 201*b* to the receiving portion 201*r* is an internally located projecting portion 201*g* in the form of a substantially horizontally projecting leg which has a plurality of apertures 201*s* in the form of 40 mm by 3 mm slots which pass through projecting leg 201*g* and extend along the longitudinal axis of the leg 201*g*-refer FIG. 7B. These slots, in use, are located behind the panel and enable air to pass there though and equalize pressure as between the outside surface and inside surface of the panels used in the cladding system of the present invention. The top and bottom mounting extrusions form, in use, the topmost and bottom most extrusions on a wall. The top and bottom panel mounting extrusions mount the panel to the wall but additionally essentially form horizontal battens at the base plate and top plate of the wall.

Figure 10:
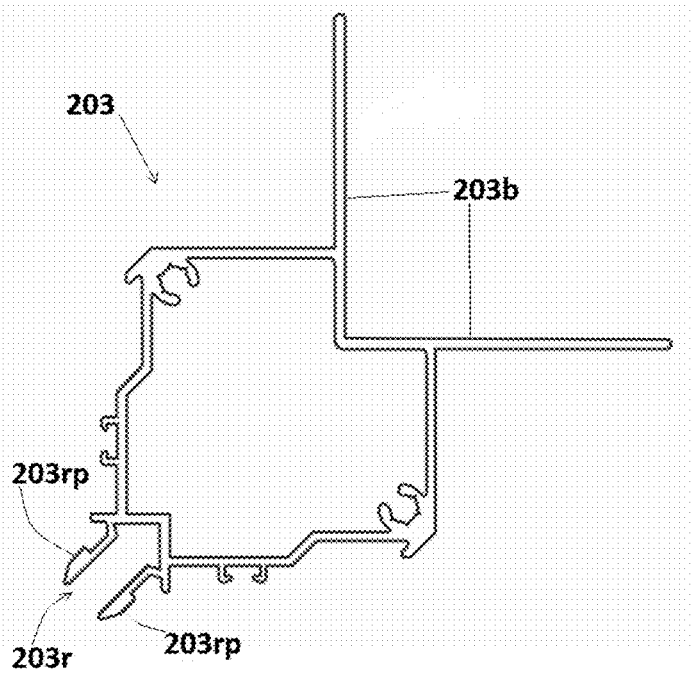
FIG. 10 show a close-up end-on view of an external corner mounting extrusion in accordance with one preferred embodiment of the present invention.
Figure 11:
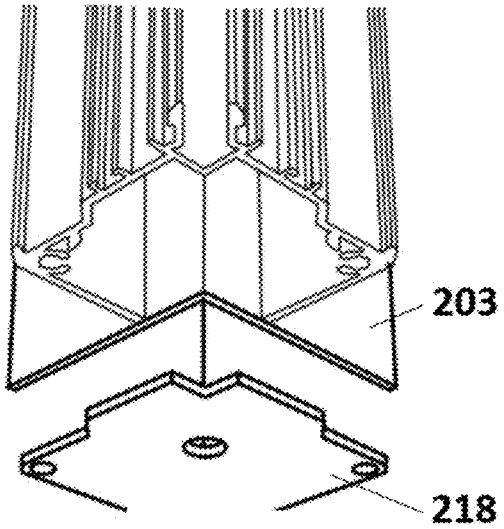
FIG. 11 shows a close-up perspective view of the external corner bottom plate being installed onto an external corner mounting extrusion.
Figure 12:
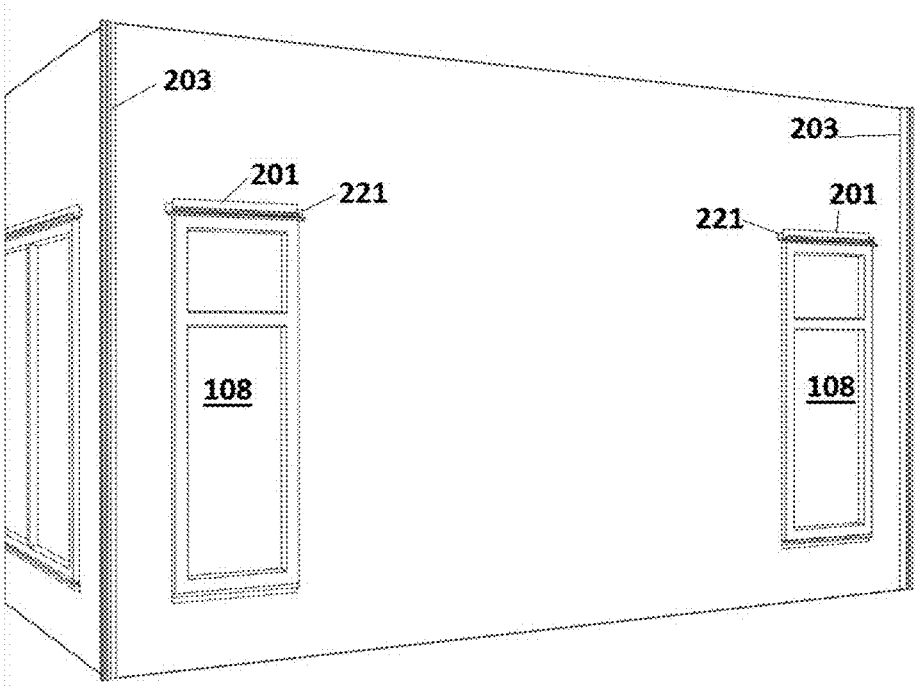
FIG. 12 shows the external corner mounting extrusions affixed to the wall of a building and top and bottom mounting extrusions affixed to flashing above the windows.

FIG. 10 shows an external corner panel mounting extrusion 203 which has a base portion 203*b* and a receiving portion 203*r*. The receiving portion is made up of two spaced apart projections 203*rp*. The receiving portion is located at an external corner of the extrusion. The corner panel mounting extrusion 203 essentially forms a vertical batten at a vertical edge of the wall or external corner of the building.

Figure 13:
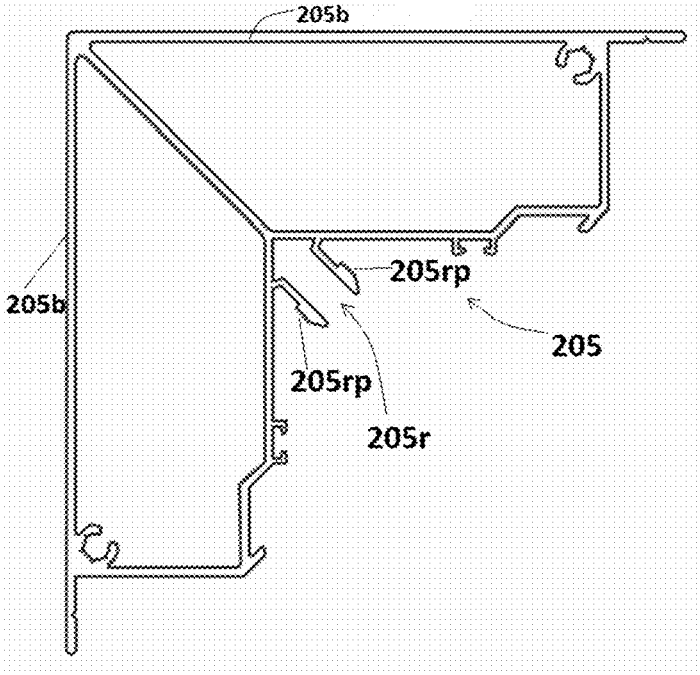
FIG. 13 show a close-up perspective and end-on view of an internal corner mounting extrusion in accordance with one preferred embodiment of the present invention.
Figure 14:
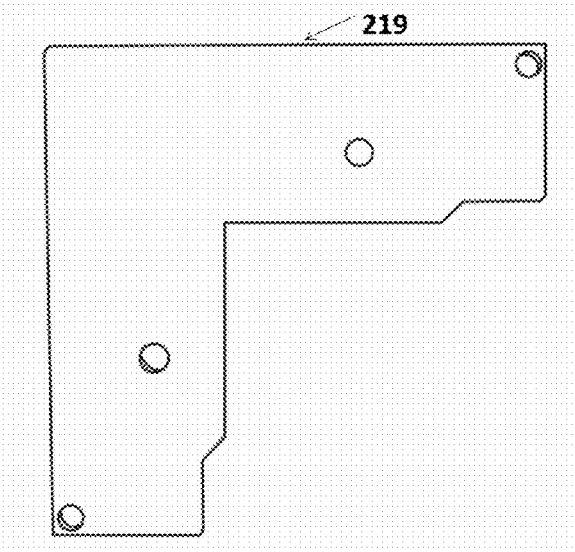
FIG. 14 shows a close-up of the internal corner bottom plate in accordance with one preferred embodiment of the present invention.

FIG. 13 shows an internal corner panel mounting extrusion 205 which has a base portion 205*b* and a receiving portion 205*r*. The receiving portion is made up of two spaced apart projections 205*rp*. The receiving portion is located at an internal corner of the extrusion. The internal corner panel mounting extrusion 205 essentially forms a vertical batten at a vertical internal corner of the wall or building.

FIG. 18 shows a vertical base extrusion 211 having a base portion 211*b* and a receiving portion 211*r*. The receiving portion is made up of two spaced apart projections 211*rp*. The base extrusion 211 is fixed by screws through the base portion and cavity battens are received by the receiving portion.

Figure 21:
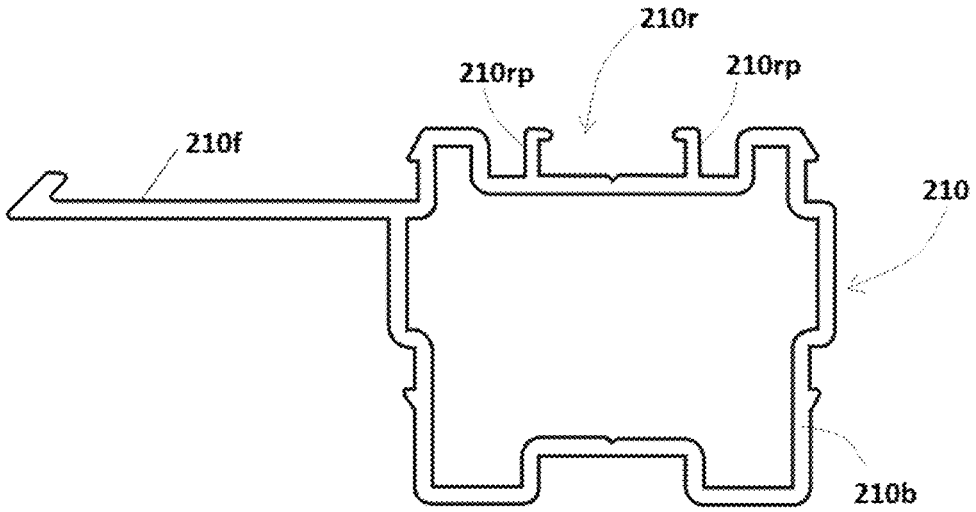
FIG. 21 shows door/window cavity battens extrusions in accordance with one preferred embodiment of the present invention.

FIG. 21 shows a door/window cavity batten extrusion 210 having a base portion 210*b* in the form of a cavity batten and a receiving portion 210*r*. The receiving portion is made up of two spaced apart projections 210*rp*. The cavity batten extrusion 210 has an integral weather flashing 210*f* sits against a frame of joinery forming the window or door frame which is placed into the wall 101.

FIG. 24 shows a vertical panel mounting extrusion 207 having a base portion in the form of an integral cavity batten 207*b* and a receiving portion 207*r* extending from said integral cavity batten 207*b*. The receiving portion is made up of two spaced apart projections 207*rp*. The panel mounting extrusion 207 includes an integral weather flashing 207*f* at each vertical edge which underlap the panel at the vertical edge of the panel.

FIG. 26 shows a cavity batten 209 having a receiving portion 209*r* and a base portion 209*b*. The receiving portion is made up of two spaced apart projections 209*rp*.

FIG. 29 shows a horizontal panel mounting extrusion 208 having a base portion 208*b* and a receiving portion 208*r*. The receiving portion is made up of two spaced apart projections 208*rp*.

FIG. 31 shows a capping extrusion 202 having two cover sections 202*cs* and an attachment portion 202*a*. The attachment portion is made up of two spaced apart projections 202*ap*. In a preferred form of the present invention the capping extrusion 202 is also used to form a panel base support attached to vertical cavity battens to contact an inside surface of the panel. Thus, a single extrusion profile is used in two different ways:

- as a cap which overlaps the vertical edges of adjacent panels, and
- as a panel base support received on vertical battens to contact and support an inner surface of the panels and receive adhesive thereon to help support the panels during installation prior to the capping extrusions being used to hold the edges of the panels in place.

Figure 37:
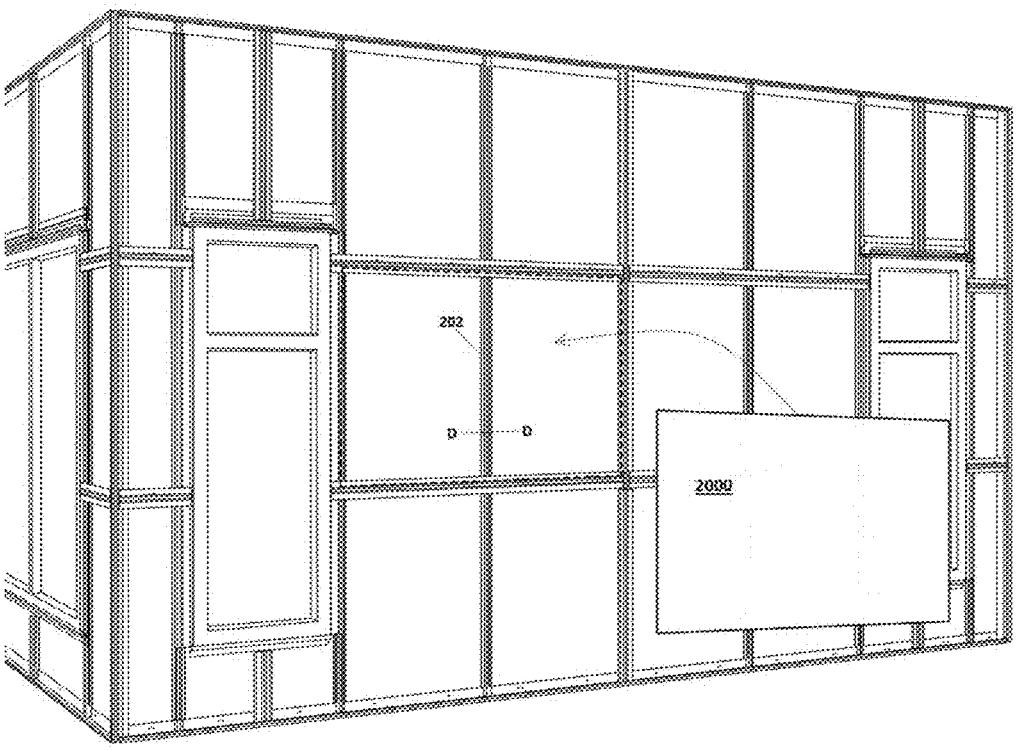
FIG. 37 shows the placement of the panel on the wall shown in FIG. 1.

FIG. 37 shows panel 2000 which is made from 2 mm thick aluminium sheet and has dimensions of 2.4 m in width as shown by the X axis and 1.2 m in height as shown by the Y axis.

FIG. 40 shows an external corner capping extrusion 204 which having two cover sections 204*cs* and an attachment portion 204*a*. The attachment portion is made up of two spaced apart projections 204*ap*. The attachment portion is located at a vertical inside corner of the extrusion 204.

FIG. 41 shows an internal corner capping extrusion 206 which has a cover section 206*cs* and an attachment portion 206*a*. The attachment portion is made up of two spaced apart projections 206*ap*. The attachment portion is located at a vertical inside corner of the extrusion 206.

Figure 43:
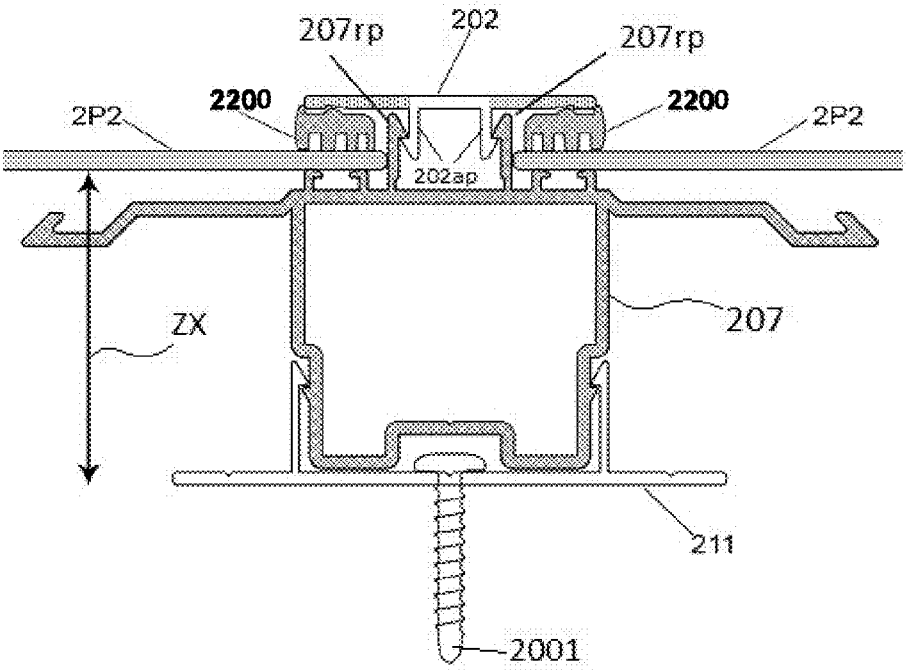
FIG. 43 shows an enlarged cross-sectional plan view of horizontally adjacent panels held between a vertical mounting extrusion and a capping extrusion through the section indicated by line A-A on FIG. 42.

FIG. 43 shows two horizontally adjacent panels 2000 which have their respective vertical edges surrounded by the receiving projections 207*rp* of the receiving portion 207*r* on the vertical panel mounting extrusion 207. Each panel overlaps the panel mounting extrusion, or in other words the panel mounting extrusion underlaps the panels at vertical edges of the panels. The extrusion 207 contacts a rear surface of the panel. It can also be seen that the capping extrusion 202 has the two attachment projections 202*ap* of the attachment portion located within the receiving portion of vertical panel mounting extrusion 207. The capping extrusion 202 also has cover section 202*cs* which overlaps with a portion of and surrounds the vertical edges of the panels 2000. The vertical edge of the panel is received between the extrusion 207 and the cover section 202*cs* of the capping extrusion. The underside of panel 2000 is separated a distance ZX which is 37 mm from the outside surface of the rigid air barrier on building frame BF to which vertical base extrusion 211 is attached by screw 2001.

Figure 44:
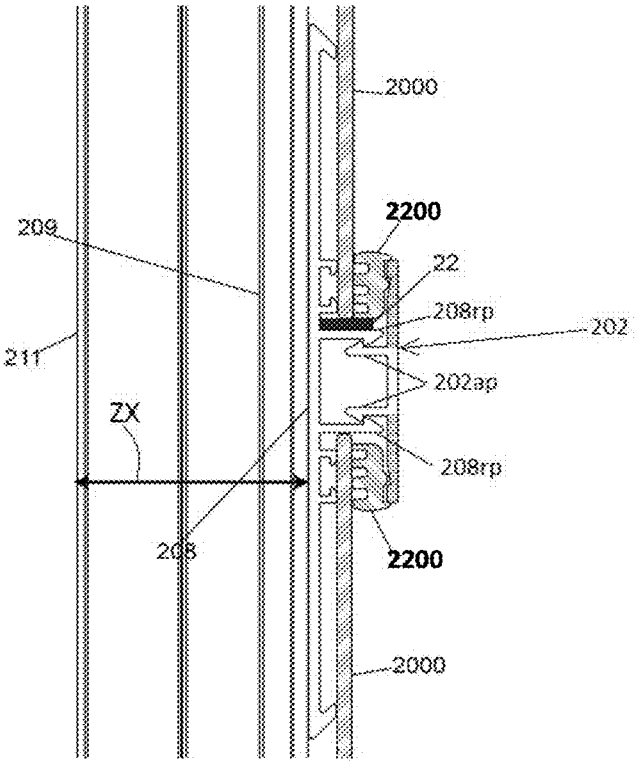
FIG. 44 shows an enlarged cross-sectional side view of vertically adjacent panels held between a horizontal mounting extrusion and a capping extrusion through the section indicated by line B-B on FIG. 42.

FIG. 44 shows two vertically adjacent panels 2000 which have their respective horizontal edges surrounded by the receiving projections 208*rp* of the receiving portion 208*r* on the horizontal mounting extrusion 208. Each panel overlaps the panel mounting extrusion 208, or in other words the panel mounting extrusion underlaps the panels at horizontal edges of the panels. The extrusion 208 contacts a rear surface of the panel. It can also be seen that the capping extrusion 202 has the two attachment projections 202*ap* of the attachment portion 202*a* located within the receiving portion of horizontal mounting extrusion 208. The capping extrusion 202 also has cover section 202*cs* which overlaps with a portion of and surrounds the horizontal edges of the panels 2000. The horizontal edge of the panel is received between the extrusion 208 and the cover section 202*cs* of the capping extrusion. The underside of panel 2000 is again separated the same distance ZX of 37 mm from the outside surface of the building frame (not shown) to which the vertical base extrusion 211 is attached via a screw (not shown).

Figure 45:
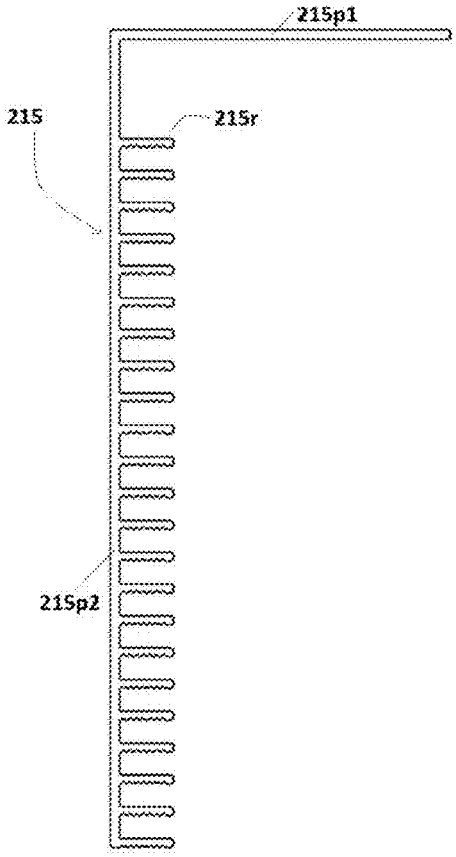
FIG. 45 shows an end on view of a right angled vertical/top transition base extrusion in accordance with one preferred embodiment of the present invention.

FIG. 45 shows a vertical/top transition base extrusion 215 which has a outermost portion 215*p*1 and a cavity portion

215*p*2 which sits within the existing window or door cavity. On the inside surface of the cavity portion 215*p*2 are a number of ribs 215*r*.

Figure 46:
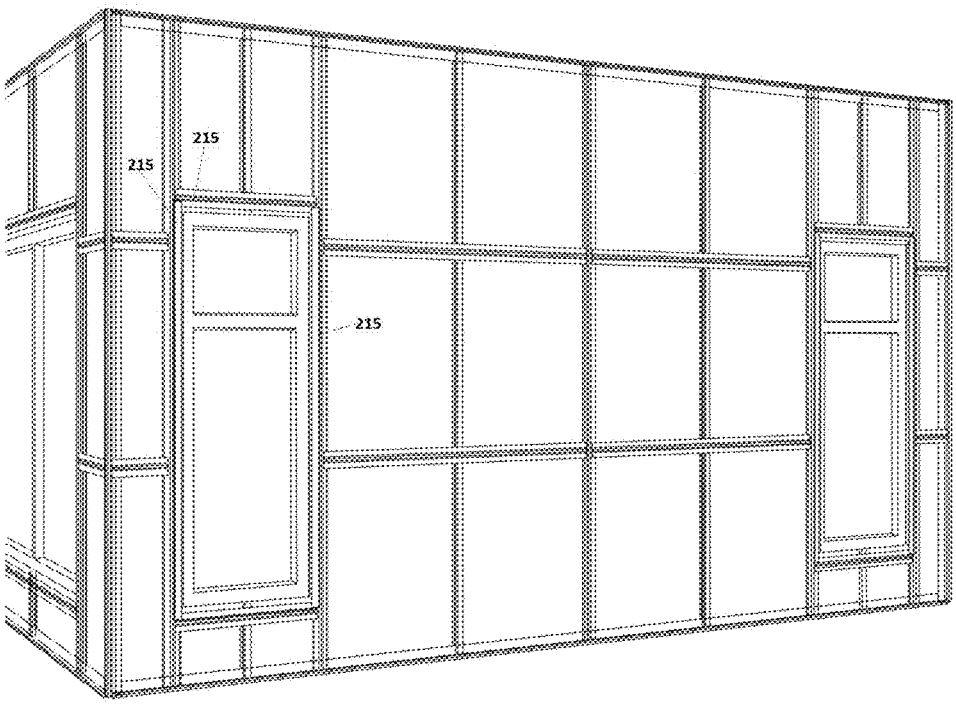
FIG. 46 shows the wall of a retrofit building which has the vertical/top transition base extrusions installed on the sides and top of the window cavity leading to the existing window which remains in situ.
Figure 47:
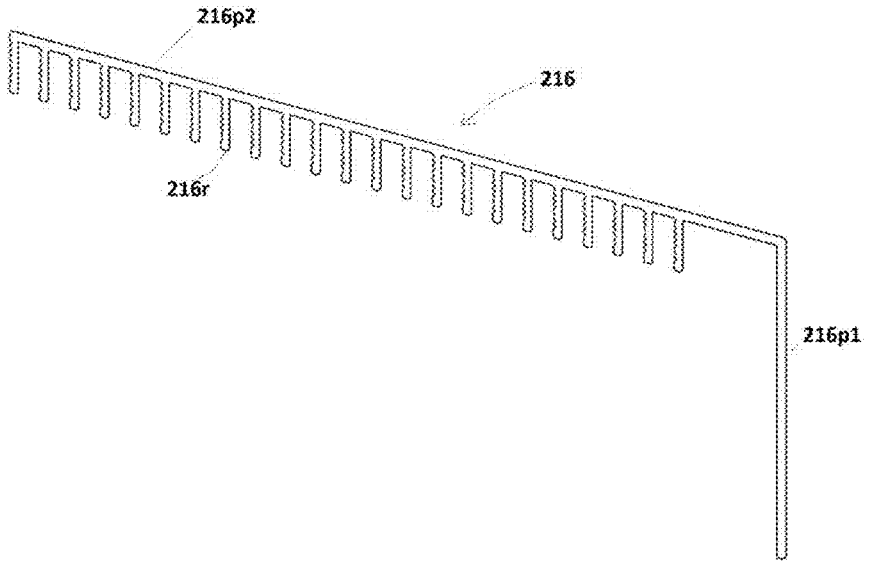
FIG. 47 shows a 105 degree angled horizontal sill transition base extrusion in accordance with one preferred embodiment of the present invention.

FIGS. 46 and 47 show a horizontal sill transition base extrusion 216 which has an outermost portion 216*p*1 and a cavity portion 216*p*2 which sits within the existing window or door cavity. On the inside surface of the cavity portion 216*p*2 are a number of ribs 216*r*.

Figure 49:
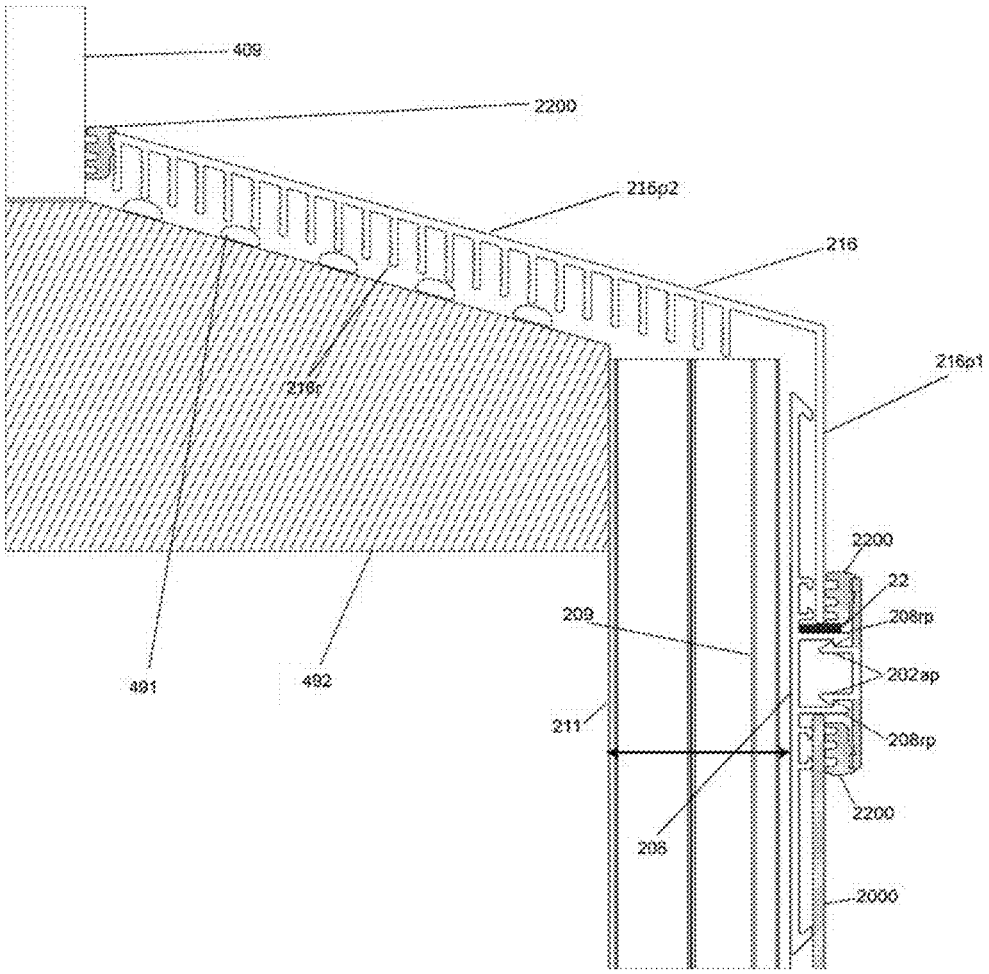
FIG. 49 shows a cross-sectional view of a transition base extrusion which extends into the window cavity of pre-clad building as part of a retro-fit but leaves a gap of 5 mm from the end of the extrusion to the surface window for insertion of the resilient sealing strip.

FIG. 49 shows a horizontal sill transition base extrusion 216 which has (if necessary) been cut to fit into the window cavity whilst leaving a 5 mm gap between the last rib 216*r* and the surface of the existing window frame 490 which enables a resilient sealing strip 2200 to be inserted there between. Adhesive 491 (such as Quilosa FMS adhesive)_is used to bond the ribs 216*r* to the existing window sill 492. The outermost portion 216*p*1 of the sill transition base extrusion 216 is captured between a horizontal panel mounting extrusion 208, resilient strip 2200 and capping extrusion 202. FIG. 49 also shows how the transition sill base extrusion then interfaces with the panel 2000. Note in FIG. 49 like reference numerals have been used for like elements described in the other Figures.

In a similar manner to what is shown in FIG. 49 the vertical/top transition base extrusions 215 are held in place with capping extrusions 202 clipped into vertical panel mounting extrusion 207.

Figure 50:
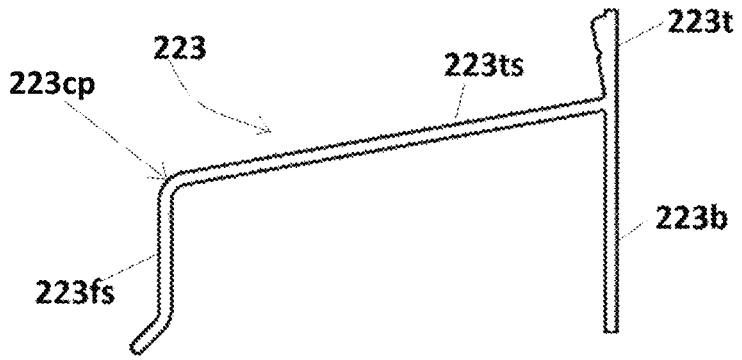
FIG. 50 shows an end on view of a stack joint flashing extrusion in accordance with one preferred embodiment of the present invention.

FIG. 50 shows a stack joint flashing extrusion 223 according to one preferred embodiment of the present invention. The stack joint flashing extrusion 223 has a base portion 223*b* to contact the wall and tab 223*t*, a cover portion 223*cp* which comprises a top section 223*ts* and a front section 223*fs*.

Figure 52:
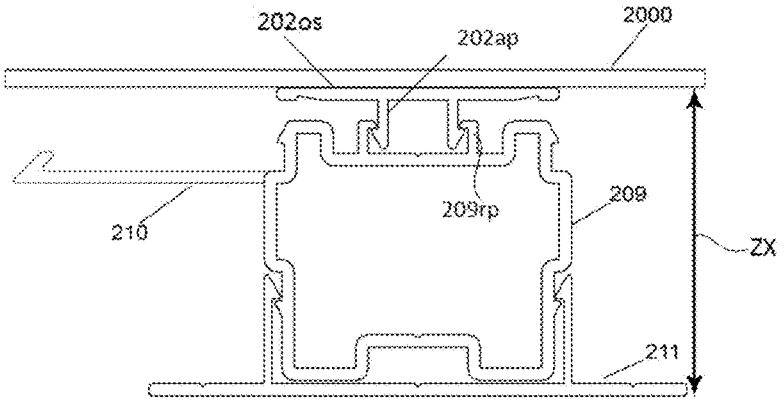
FIG. 52 shows a cross-sectional view along line D-D on FIG. 37.

FIG. 52 shows cavity batten 209 clipped into vertical base extrusions 211 at mid-panel intervals where adhesive (not shown) has been placed on the outer surface 202*os* of capping extrusion 202 to help hold the panel in place during installation. The dotted outline indicates the weather flashing 210*f* on window/door cavity batten 210 in a new build (which is otherwise the same as cavity batten 209). The window/door cavity batten is also used in a similar way—to cavity batten 209—but against windows and doors a key difference being that adhesive is not applied to the outer surface 202*os* of the capping extrusion clipped to window/door cavity batten 210. The underside of panel 2000 is again separated the same distance ZX of 37 mm from the outside surface of the building frame (not shown) to which the vertical base extrusion 211 is attached via a screw (not shown).

Example 2—Retrofit Cladding System for Existing Buildings (not Restricted to Aluminum Joinery for Windows and Doors for the Existing Building)

In this example a portion of an existing building which has a wall clad with plywood (plyboard) and stucco and having windows therein, is to be retrofitted with pre-painted aluminium panels, without removing the existing cladding or windows or doors. This retrofit process will now where appropriate be described in relation to the wall 101 of Example 1 and using like reference numerals, method steps, examples and figures from Example 1 described above.

The Figures will now all be described in relation to one preferred method of retrofitting cladding to an exterior wall of an existing building with rectangular pre-painted aluminium panels which are going over a wall having an existing stucco finish onto which the mounting extrusions installed, the method comprising the steps of:

Retro Fit

Substantially repeated steps from Example 1 a) Installing bottom plate 218 to the bottom of an external corner panel mounting extrusion 203. If there is an internal corner then install bottom plate 219 to internal corner panel mounting extrusion 205);—refer FIGS. 9,10, 11, 13 and 14.

b) Installing external corner panel mounting extrusion 203 with screws at 450 mm centres to the external corner edges of the wall 101. If there are any internal corners internal corner panel mounting extrusions 205 would be installed also; refer FIG. 12.

c) Cutting top and bottom panel mounting extrusions 201 to fit into the external corner panel mounting extrusion 203 (and if required fitting top and bottom mounting panel extrusions 201 to internal corner panel mounting extrusion 205;—refer FIGS. 15 and 16.

d) Installing top and bottom panel mounting extrusions 201 via screws to the ceiling plate (not shown) and sole plate (not shown) of the wall;—refer FIG. 17 e) Installing vertical base extrusions 211—via screws and adhesive (at 450 mm centres and where required)—next to:
windows 103 (and door(s));
at mid-panel intervals; and also
wherever vertical panel joins will be required;—refer FIGS. 18 and 19 f) Clipping vertical panel mounting extrusions 207 which include an integral cavity batten into the vertical base extrusions 211 next to windows and doors and where vertical panel joins will be required;—refer FIG. 25 g) Clipping cavity battens 209 into vertical base extrusions 211 at mid-panel intervals;—refer FIGS. 26, 27.

h) Installing horizontal panel mounting extrusions 208—via screws—to cavity battens 209,210 where horizontal joins between adjacent panels are required and above windows/doors, to span between vertical panel mounting extrusions 208;—refer FIGS. 29 and 30 i) Clipping capping extrusions 202 to mid-panel located cavity battens 209 to span between horizontal panel mounting extrusions 208 and top and bottom mounting extrusions 201; —FIGS. 31 and 32, 33

Figure 48:
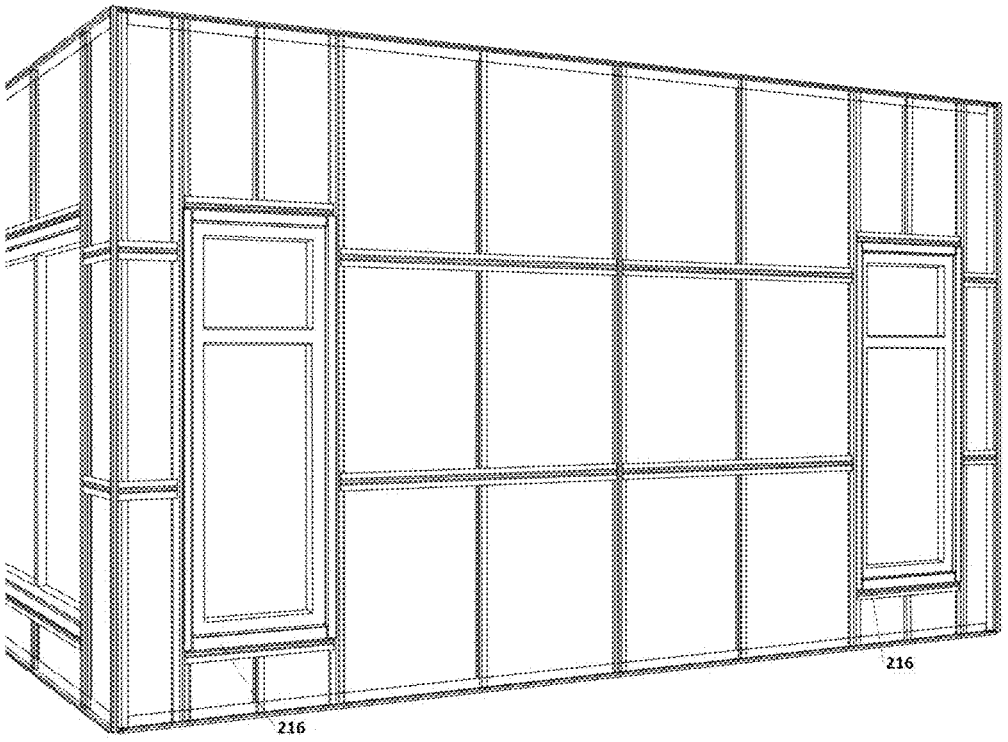
FIG. 48 shows the wall of the retrofit building in FIG. 46 with the horizontal sill transition base extrusions installed.

New Retro Fit Window Steps j) Installing vertical/top transition base extrusions 215 to both sides of the window or doors using adhesive;—refer FIGS. 45 and 46. Preferably, the Adhesive may be Quilosa FMS Adhesive. In FIG. 46 it the exterior wall 101 has a stucco surface 1070 instead of the rigid air barrier in Example 1.

k) Installing vertical/top transition base extrusion 215 to a top of window/door using adhesive;—refer FIGS. 45 and 46 l) Installing horizontal sill transition base extrusion 216 to bottom of window/door using adhesive;—refer FIGS. 47 and 48

Further detail about the new retro fit steps are shown and described in relation to FIG. 49.

Retro Fit

Substantially repeated steps from Example 1 n) Inserting spacer blocks 22 on top of the horizontal panel mounting extrusions 201,208 so they can in use support the base of the panels; FIGS. 34 and 35.

o) Applying adhesive (not shown) onto capping-extrusions 202 which form a panel base support and will be located intermediate vertical edges of panels and preferably in the vertical mid-line of the panels 2000 during installation before you fit panels. The dashed lines in FIG. 37 indicate panel placement and capping extrusion 202 (on the vertical mid-line) onto which the adhesive is placed. It is to be noted the height and width of panels 2000 are cut to be 3 mm less than the distance between adjacent vertical panel mounting extrusions and adjacent horizontal panel mounting extrusions.

p) Clipping external corner capping extrusion 204 to external corner extrusion 203 (and if required clipping internal corner capping extrusion 206 (not shown) to internal corner extrusion 205 (not shown)) as indicated by reference numeral 1;—refer FIGS. 39, 40 and 41.

q) Clipping capping extrusion 202 to top and bottom panel mounting extrusions 201 as indicated by reference numeral 2;—refer FIGS. 31 and 39 r) Clipping capping extrusion 202 to vertical panel mounting extrusion 207 as indicated by reference numeral 3;—refer FIG. 39.

s) Clipping capping extrusion 202 to horizontal panel mounting extrusion 208 as indicated by reference numeral 4;—refer FIG. 39 t) Inserting a resilient sealing strip 2200 (shown in FIGS. 43 and 44) e.g. a strip of Santoprene™ thermoplastic elastomer under the capping extrusions in the sequence of horizontal capping extrusions first; followed by vertical capping extrusions second; as indicated by reference numerals 1 and 2 in FIG. 42. The insertion of the sealing strip may be facilitated by the use of a glazing roller (not shown);

u) Inserting the resilient sealing strip 2200 between ribs 215*r*, 216*r* as indicated in FIG. 49 to create a seal with the existing window/door frame.

Example 3—Cladding or Re-Cladding Multi Level Buildings

Figure 51:
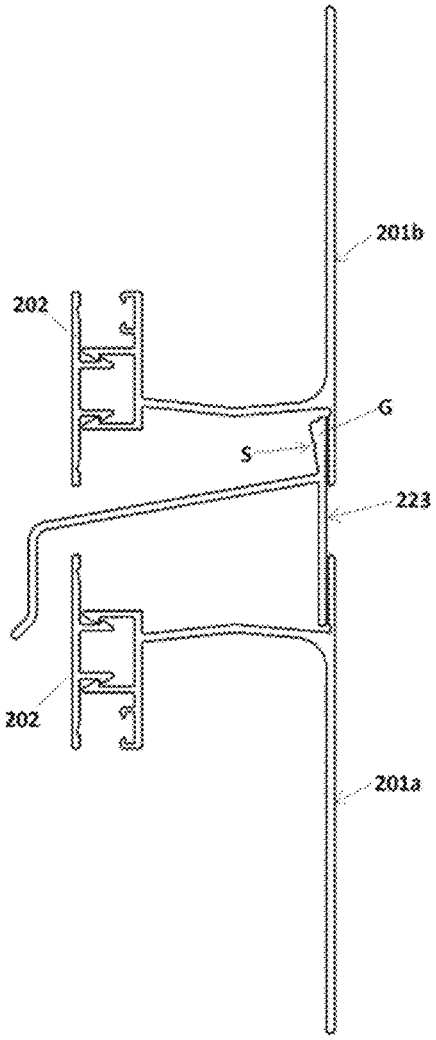
FIG. 51 shows a side on view of a stack joint flashing being used in a multi-level building.

The present invention also encompasses cladding a two or multi-story building (not shown). The components and methodology used for cladding the additional levels may be substantially the same as outlined for new builds and retrofits as per Example 1 and 2 above. The additional requirement for adding a level above an existing wall is the requirement for a stack joint formed from:

- a stack joint flashing extrusion 223 located above and overlapping with a portion of a top/bottom mounting extrusion 201*a* on the top edge of a wall; and
- an additional top/bottom mounting extrusion 201*b* located above and overlapping with a portion of the stack joint flashing extrusion 223;—refer FIGS. 50 and 51.

The top/bottom mounting extrusions 201 have capping extrusions 202 clipped thereto—refer FIG. 51. A screw (not shown) is used to affix the stack joint flashing extrusion 223 to the building frame in the direction indicated by arrow S. It can be seen that tab 223*ts* has a groove G therein for locating the tip of the screw.

Example 4—Best Modes Exemplars—Door/Window Flashing

Figure 6:
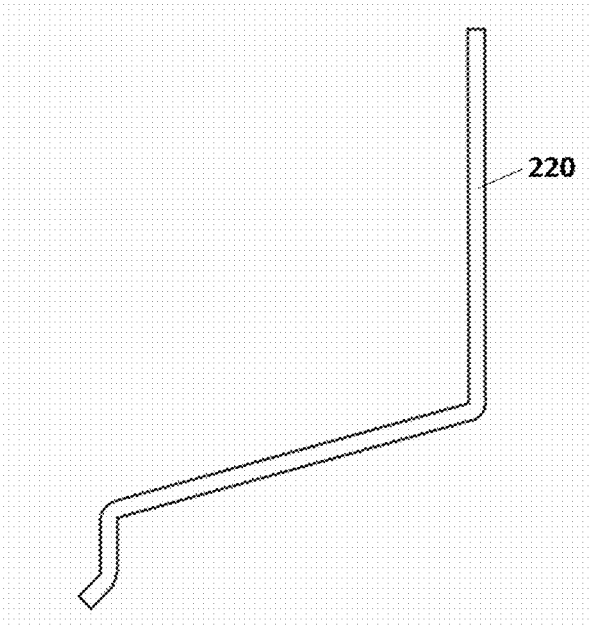
FIG. 6 shows an end-on view of a window/door flashing in accordance with one preferred embodiment of the present invention.
Figure 7B:
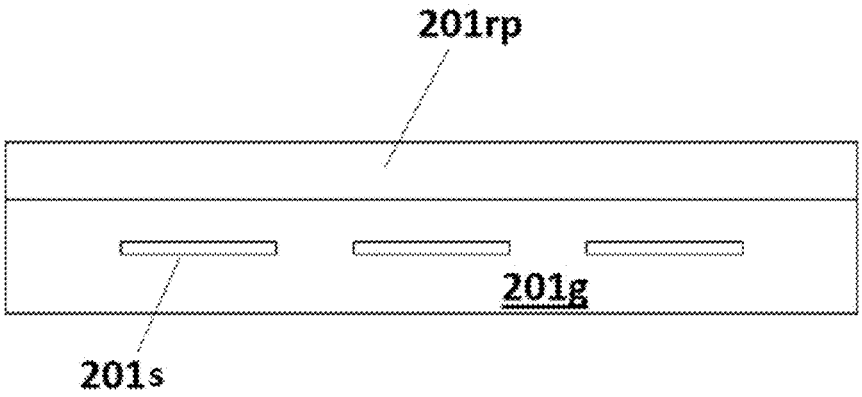
Figure 53:
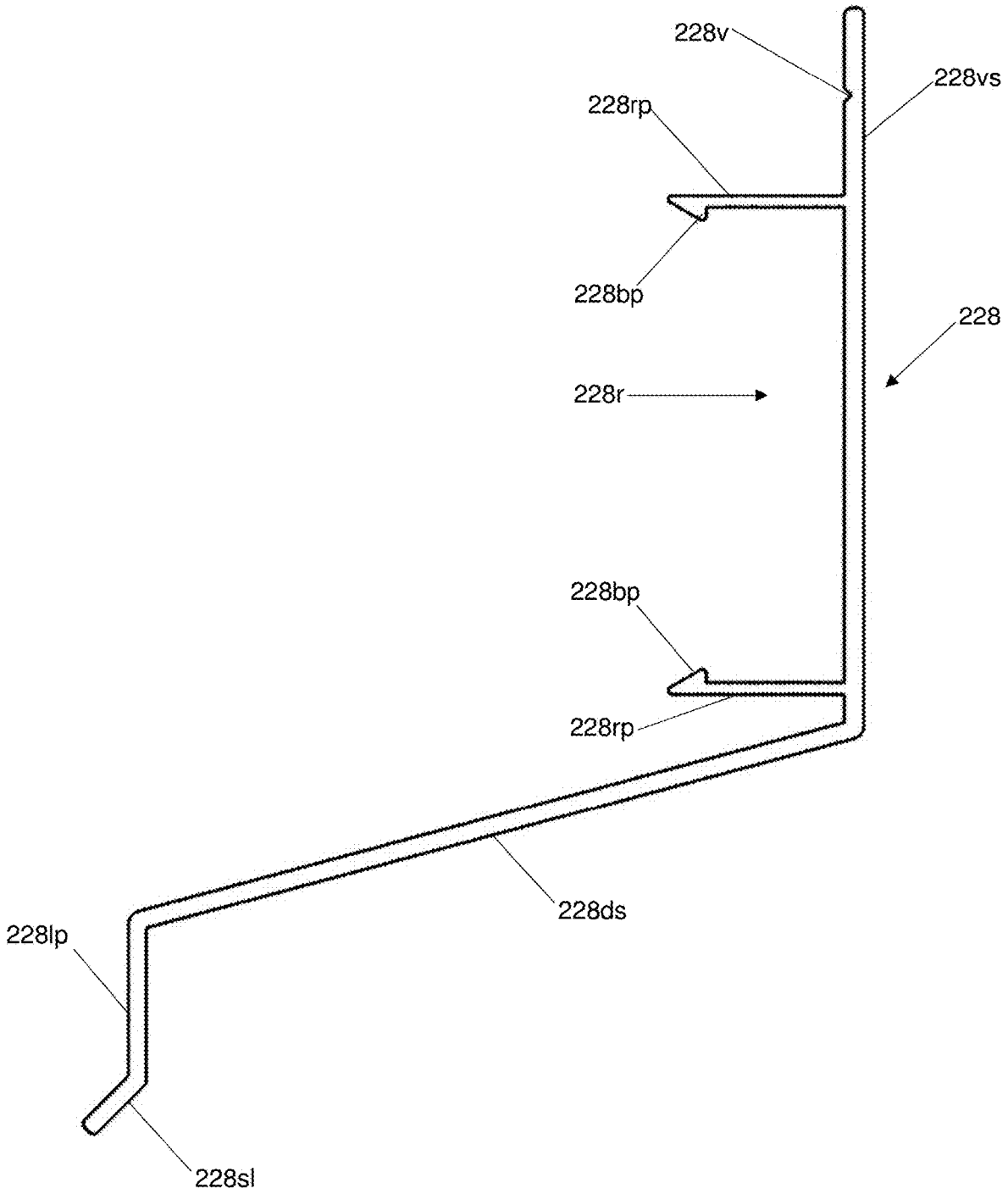
FIG. 53 shows an end-on view of a window/door—batten receiver (WDBR) flashing in accordance with one preferred embodiment of the present invention.
Figure 54A:
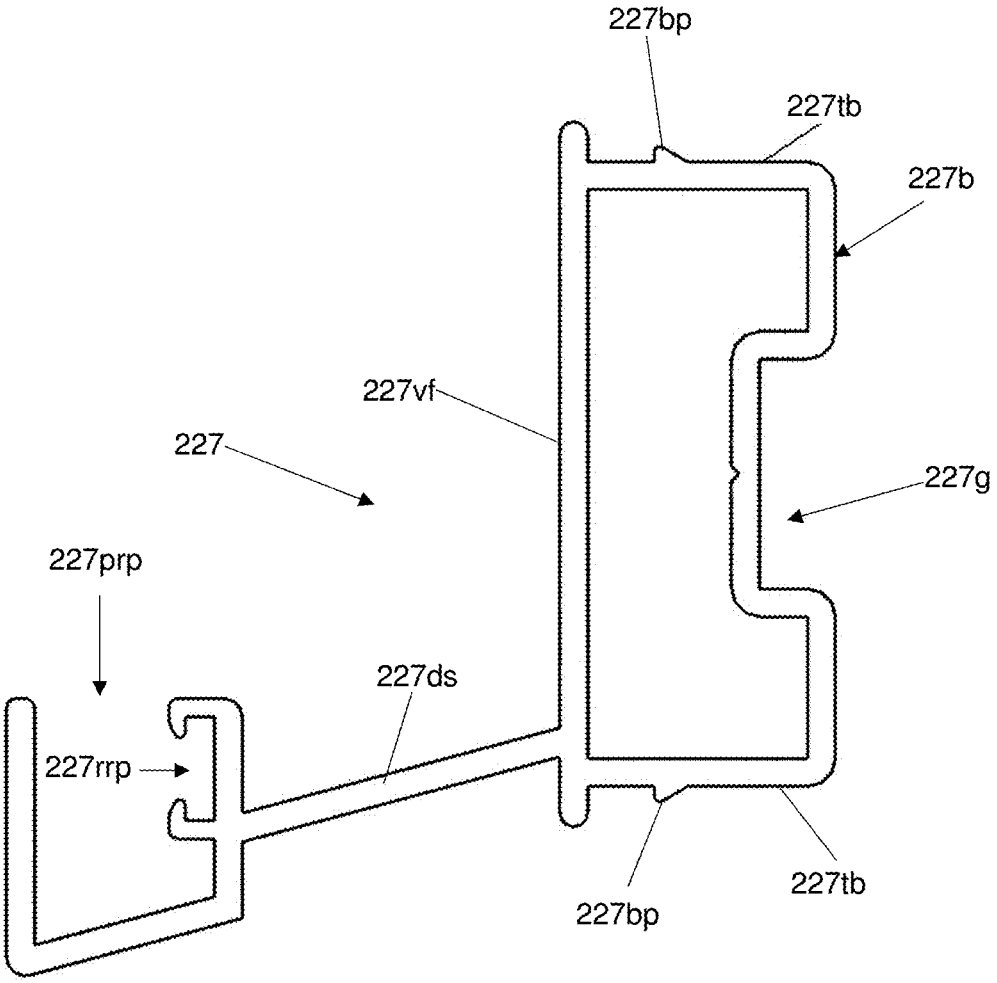
FIGS. 54A & 54B show an end-on view and bottom view respectively of a top and bottom (TB) panel-batten extrusion in accordance with one preferred embodiment of the present invention.
Figure 54B:
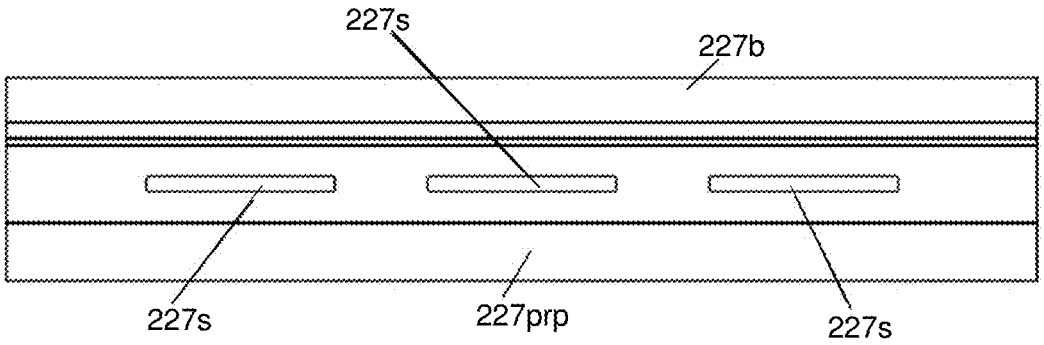
Figure 55:
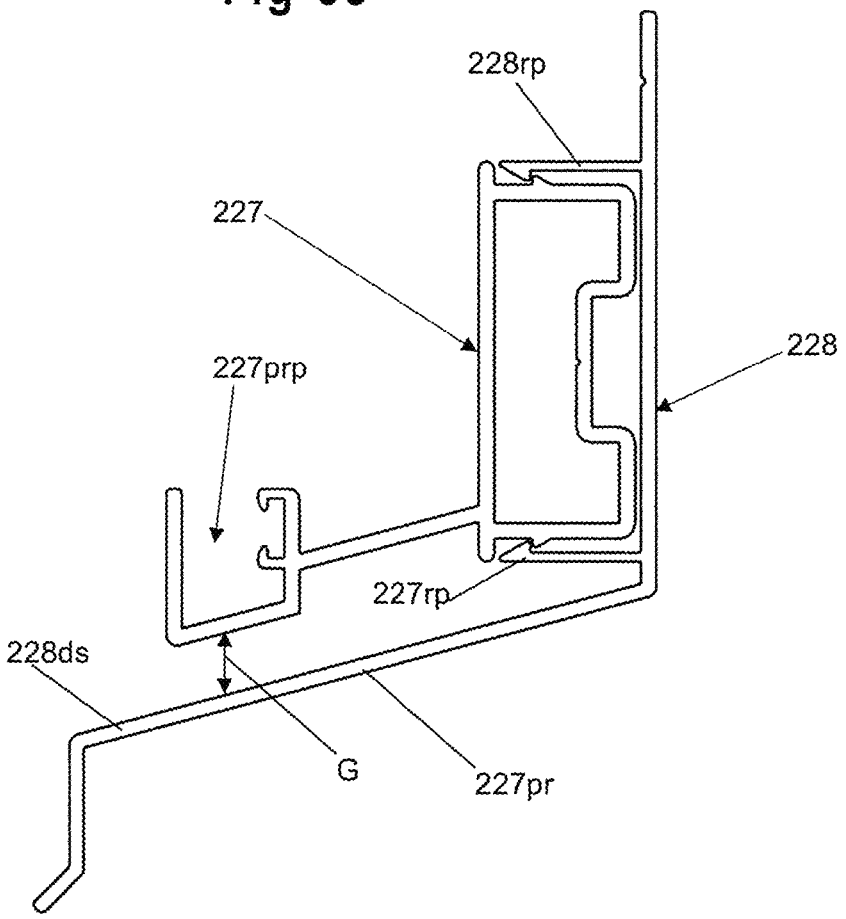
FIG. 55 shows the (TB) panel-batten extrusion affixed to (WDBR) flashing above a window.

With respect to FIGS. 53-55 there is provided preferred parts which can be used in place of the extrusions previously shown and described in relation to FIGS. 6 and 7A,7B.

In particular:

- a window/door—batten receiver (WDBR) flashing extrusion 228 shown in FIG. 53 replaces the flashing 207 shown in FIG. 6; and
- a top and bottom (TB) panel-batten extrusion 227 shown in FIGS. 54A and 54B replaces the top/bottom mounting extrusion 201 shown in FIGS. 7A and 7B.

Figure 22:
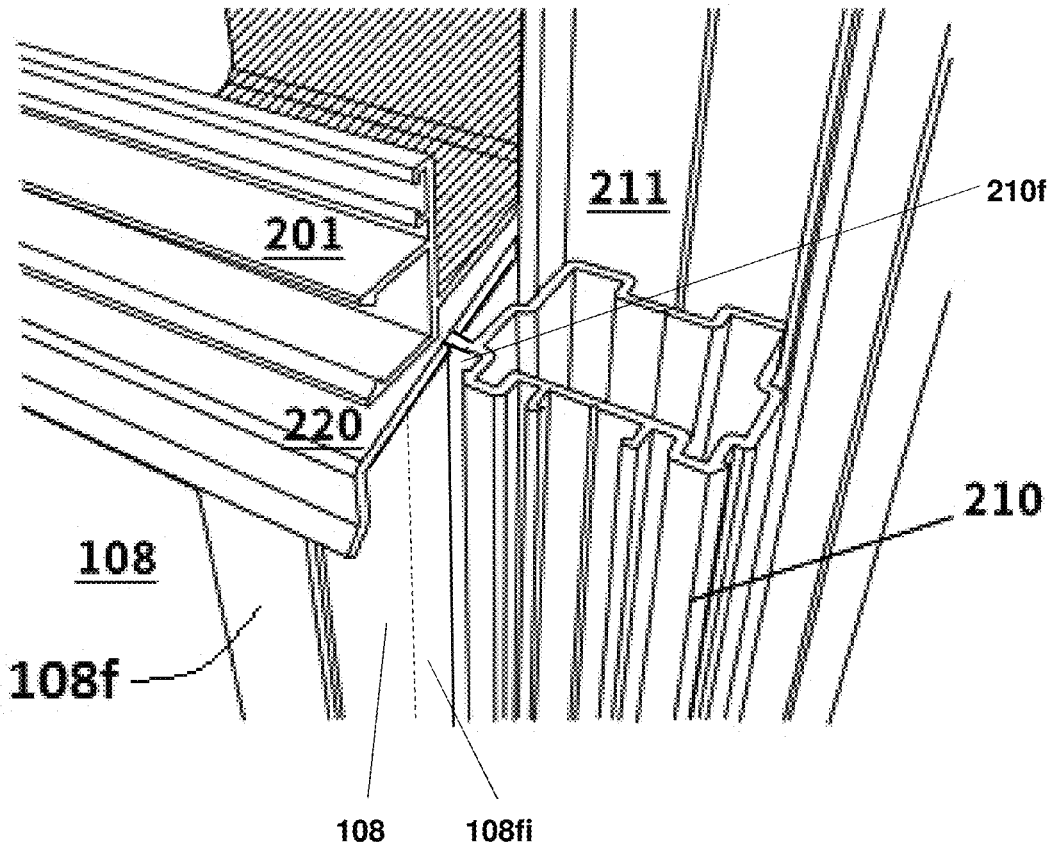
FIG. 22 shows the door/window mounting extrusion clipped into the vertical mounting extrusions shown in FIG. 19.
Figure 23:
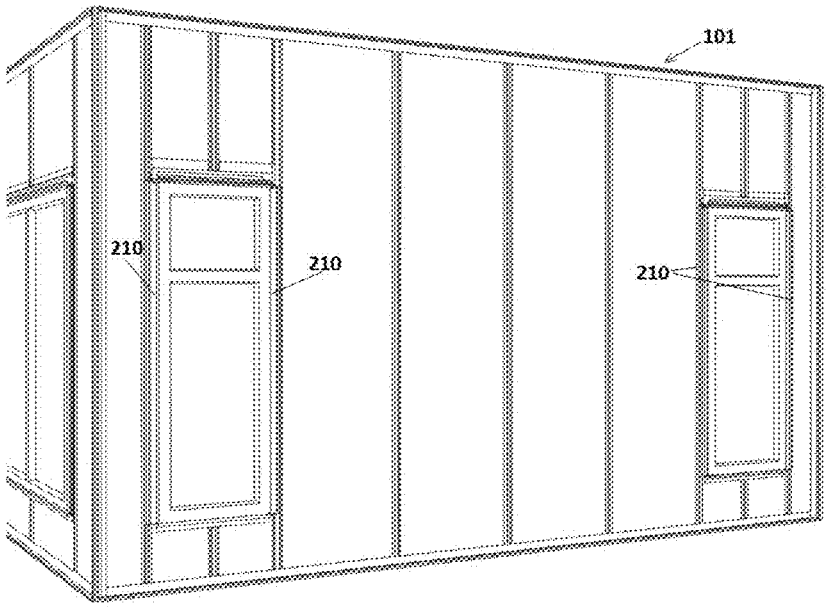
FIG. 23 shows the wall of FIG. 1 with the door/window mounting extrusions installed next to the windows.

By way of further example, the WDBR flashing 228 and TB panel-batten extrusion 227 are also shown in FIGS. 53-55 which depict the new preferred parts in place of the parts 207 and 201 shown in FIGS. 20 and 22.

Furthermore:

FIG. 53 shows an end on view of a WDBR flashing extrusion 228 which has:

- a vertical section 228*vs* which is substantially planar;
- a downwardly sloped planar section 228*ds* extending outwardly from the lower end of the vertical section;
- a lip portion 2281*p* which extends downwardly and substantially vertically from said downwardly sloped section before having finishing with an outwardly direct sloped lip 228*s*1;
- a panel-receiving (PR) portion 228*r* made up of two spaced apart projections 228*rp*.

The WDBR flashing extrusion 228 also has a v-notch groove 228*v* therein which helps locate the tip of a screw (not shown) used for securing the WDBR flashing extrusion 228 to a building frame.

FIG. 54A shows an end on view of a top and bottom (TB) panel mounting extrusion 227 which has a polygonal batten portion 227*b* which is a hollow substantially rectangular shape. The batten portion 227*b* has a vertical outward face 227*vf* from which a downwardly sloped planar section 227*ds* extends from a lower region thereof. It can be seen that the downwardly sloped planar section 227*ds* has an angle of around 15 degrees with respect to the horizontal and the vertical outward face 227*vf* has an angle of substantially 90 degrees to the horizontal. However, this angle for the vertical outward face could be anywhere between substantially 75-90 degrees with respect to the horizontal.

At the distal end of the downwardly sloped planar section 227*ds* is a panel-receiving (PR) portion 227*prp*. The panel-receiving portion 227*prp* is substantially u-shaped and has a resilient sealing strip retaining portion 227*rrp* in the form of two spaced apart projections having curved distal ends. The resilient sealing strip, in use, can receive and retain a further resilient sealing strip (not shown) which enables for example a glass panel to be used as panel 2000 in place of an aluminium panel. The resilient sealing strip housed in retaining portion 227*rrp* providing a contact surface with the inner surface of the glass and preventing the glass panel from contacting the aluminium of the retaining portion 227*rrp*. Alternatively, if smaller thickness panels are used the retaining portion 227*rrp* can be used to house a further resilient sealing strip (not shown) which acts as a packer to firmly hold the panel in place.

Figure 61:
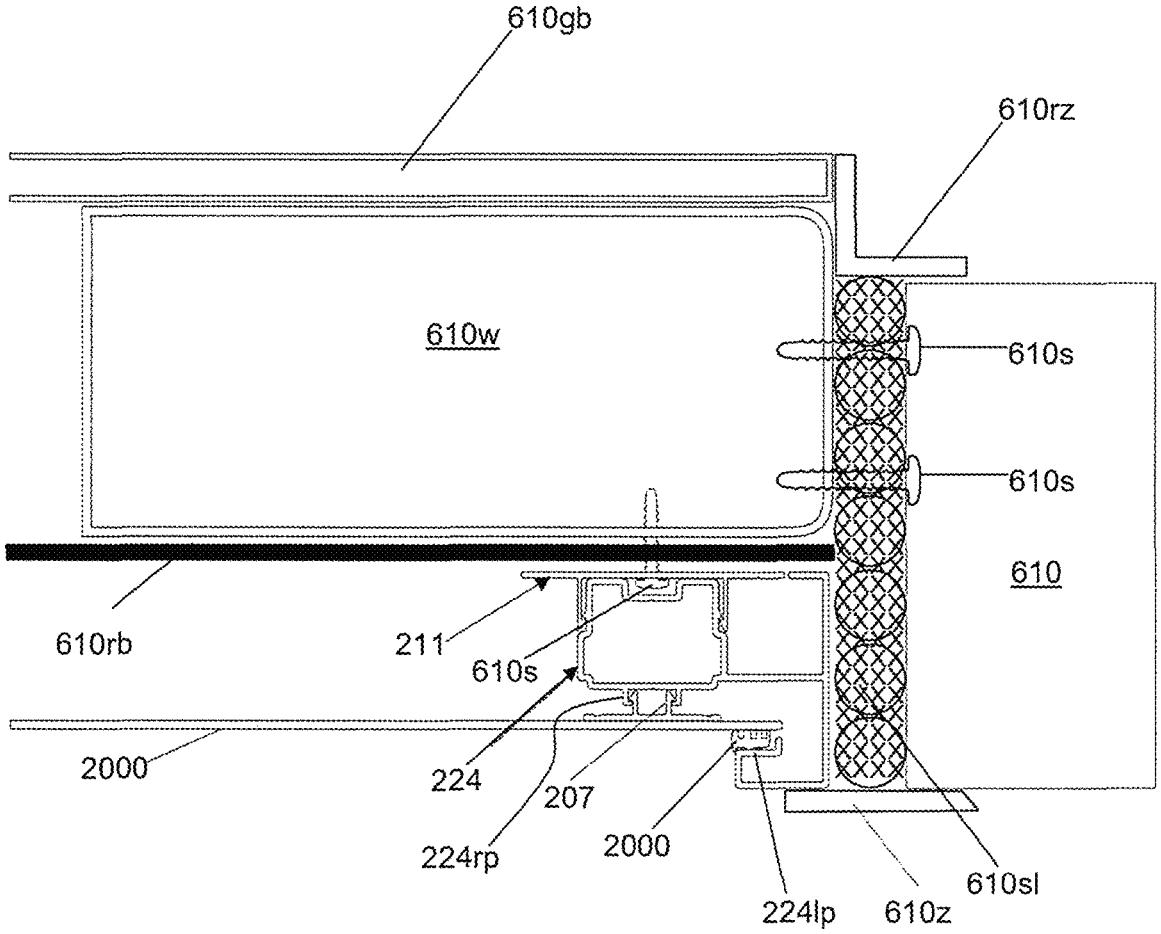
FIG. 61 shows a top schematic view of the transition batten extrusion in use adjacent a commercial window or door aluminium joinery which is without fins (i.e. has a flush faced window/door frame)

The batten portion 227*bp* has on the inner face 227*if* a groove 227*g* which importantly accommodates a screw head (not shown in FIG. 54A—but see FIG. 61 where the TB panel-batten extrusion 227 is shown in use).

FIG. 54B_shows the underside of the TB panel-batten extrusion 227 and in particular illustrates a plurality of apertures 227*s* in the form of 40 mm by 3 mm slots which pass through the downwardly sloped planar section 227*ds* and extend along the longitudinal axis thereof. These slots enable air to pass there though and equalize pressure as between the outside surface and inside surface of the panels used in the cladding system of the present invention.

FIG. 55 (also referring back to FIGS. 53, 53A and 54B) shows the batten portion 227*b* of FIG. 54A clipped into the receiving portion 228*r* on the WDBR flashing extrusion 228 of FIG. 53. The batten portion 227*b* has parallel top and bottom surfaces 227*tb* which each have barbed protrusions 227*bp* which are substantially triangular and configured to deform and then be retained by corresponding barbed protrusions 228*bp* on the projections 228*rp* on the WDBR flashing extrusion 228—all as clearly shown.

FIG. 55 also shows a gap G which is substantially 5.5 mm between the base 227*prb* of the panel receiving portion 227*prp* and the respective downwardly sloped planar section 228*ds* on the WDBR flashing extrusion 228. The applicant has found that if the gap is below 5.5 mm then water has the tendency to flow as a stream of liquid which gives the liquid what may be termed a penetrative force which can lead to leaks especially in high wind. By way of contrast when the gap is at least 5.5 mm this distance is sufficient to enable the stream to become dislocated into droplets which lack the force to penetrate particularly against the force of gravity.

Figure 56:
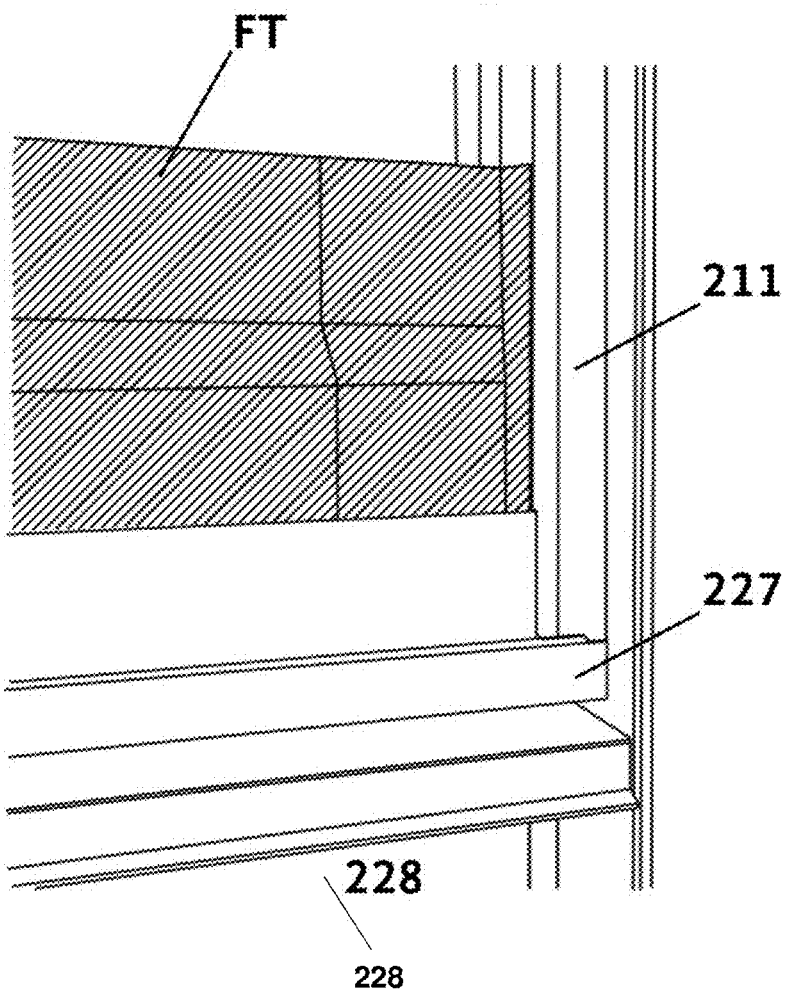
FIG. 56 shows a close-up of weather flashing tape installed on top mounting extrusions located above windows.
Figure 57:
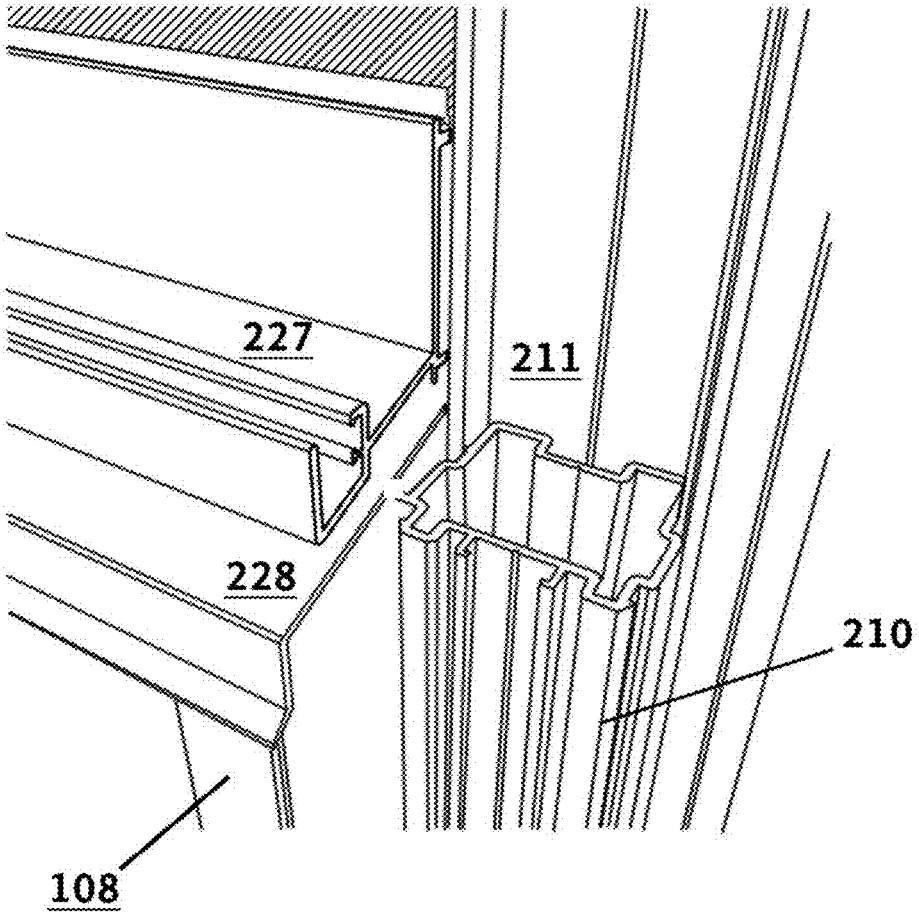
FIG. 57 shows the door/window mounting extrusion clipped into the vertical mounting extrusions shown in FIG. 19 as depicted in FIG. 22 but including a preferred WDBR flashing and TB panel-batten extrusion, used above a window (or doors), in place of, the flashing 220 and top and bottom mounting extrusion 201.

FIGS. 56 and 57 are the same view as shown and previously described in relation to FIGS. 20 and 22 respectively with the exception that it shows the new WDBR flashing extrusion 228 and new TB panel-batten extrusion 227 in place of the flashing 220 and panel mounting extrusions 201 respectively.

Figure 8:
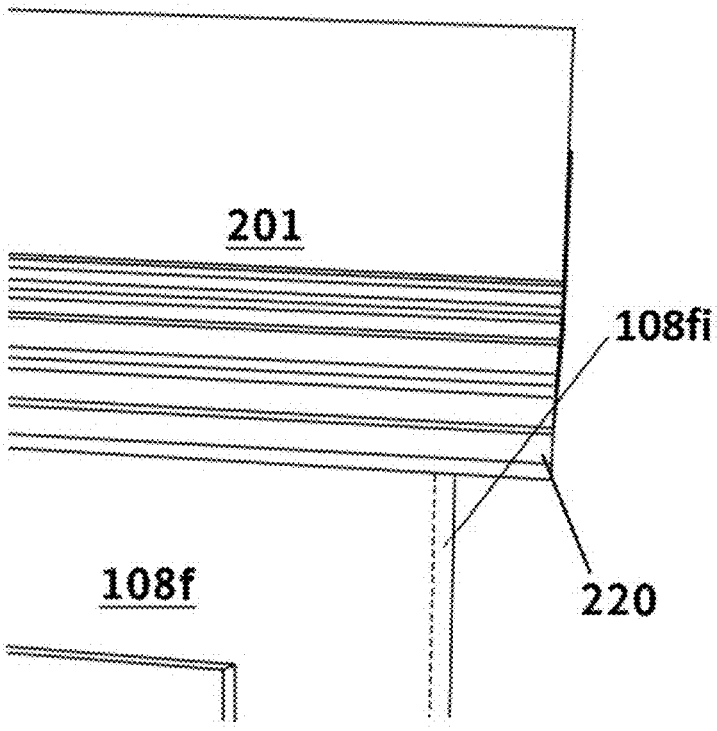
FIG. 8 shows the top and bottom mounting extrusion affixed to flashing above window.
Figure 9:
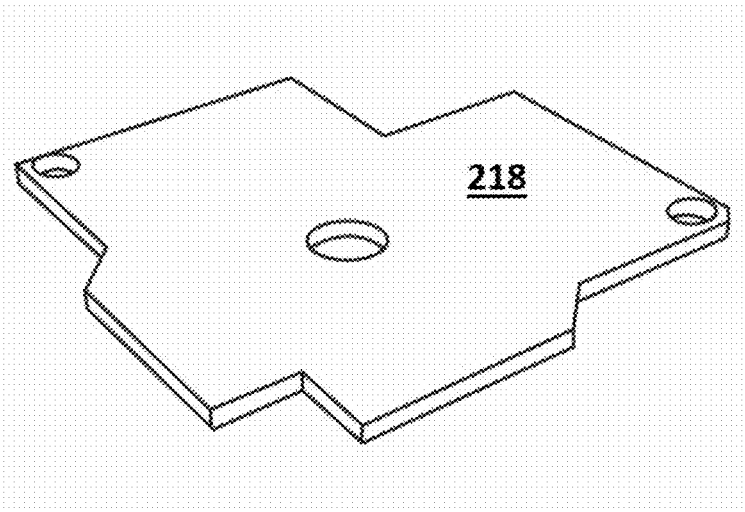
FIG. 9 shows a close-up perspective view of the external corner bottom plate in accordance with one preferred embodiment of the present invention.

It is to be noted that the WDBR flashing extrusion 228 and TB panel-batten extrusion 227 now preferably replace the top/bottom mounting extrusion 201 and flashing 220 above windows and doors as shown in FIG. 8.

Example 5—Best Modes Exemplars—Multi-Level Building

Figure 58:
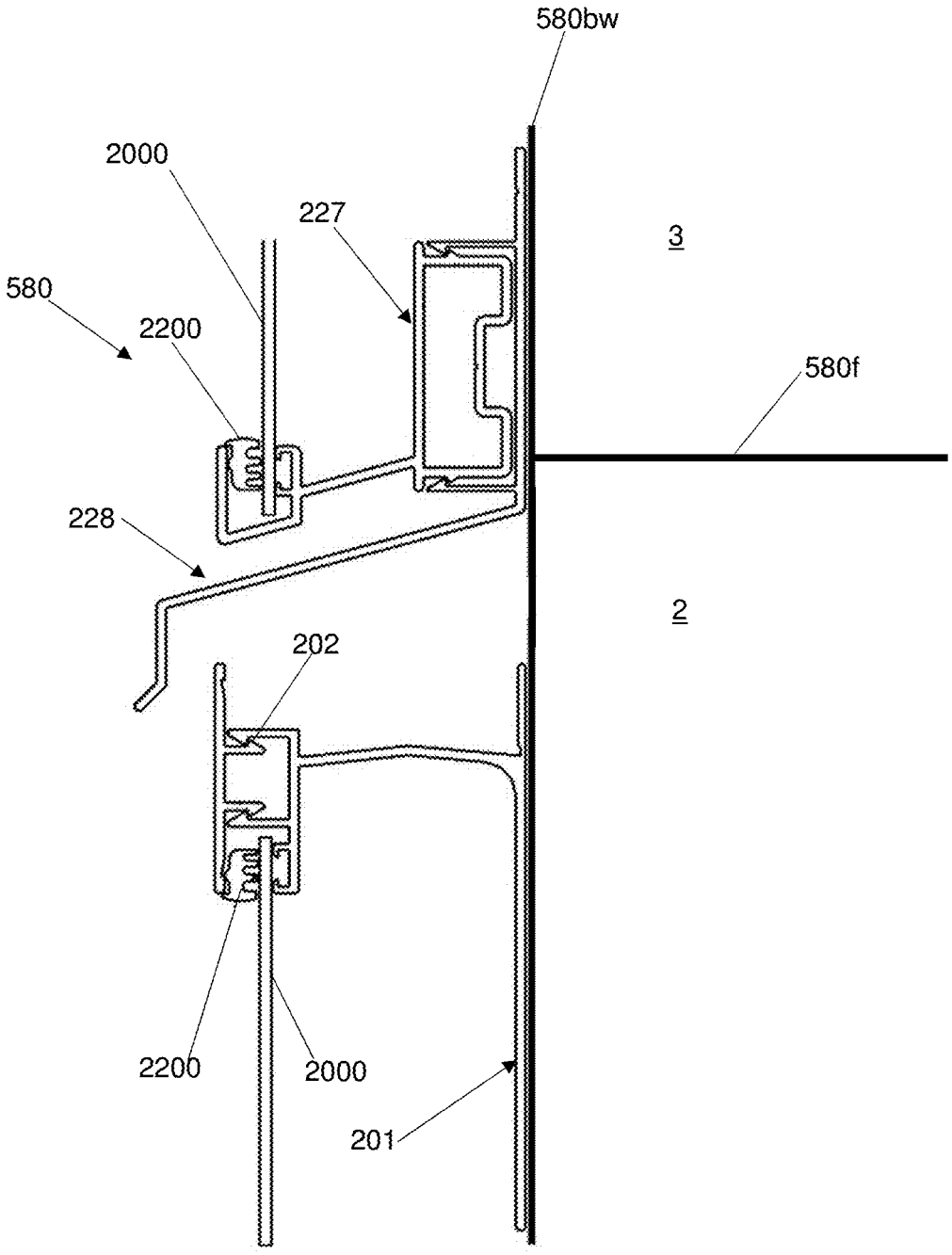
FIG. 58 shows a side on view of a stack joint being used in a multi-level building.
Figure 59:
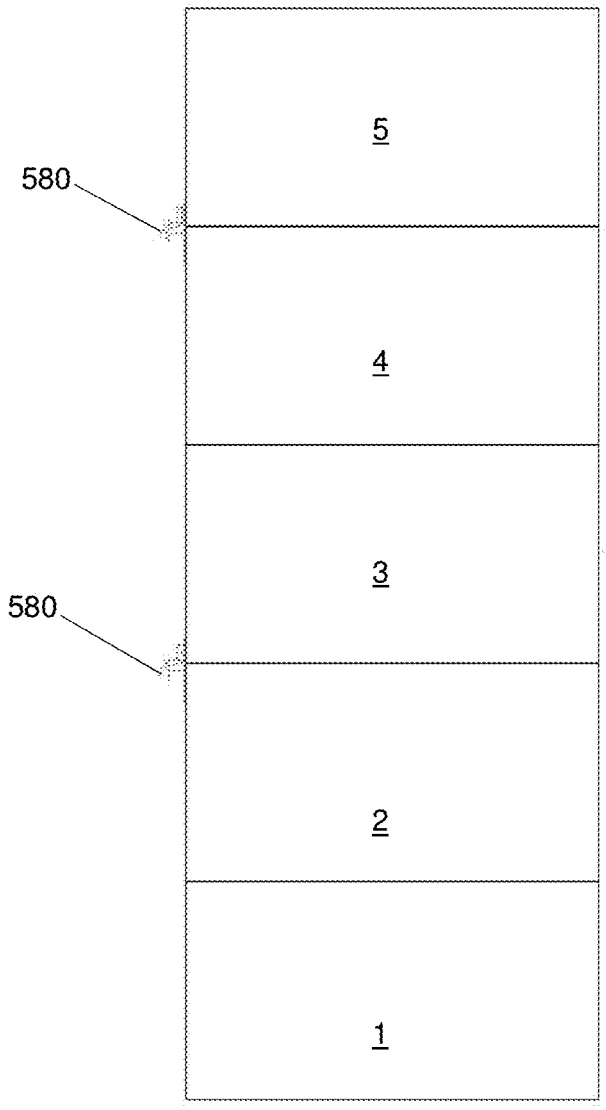
FIG. 59 shows a schematic side cross-sectional view of a multi-level building using the multi-level joint shown in FIG. 58.

With respect to FIGS. 58 and 59 there is provided a preferred stack joint 580 for use in multi-level buildings. This joint 580 is used in place of the stack joint formed around the stack joint flashing extrusion 223 with top/bottom mounting extrusions 201*a* and 201*b* as shown in, and described in relation to, FIG. 51.

The method for using this joint 580 is similar to that described above in Example 3 above except that in this example the stack joint is used only at every second storey (level) as also shown in FIG. 59 where reference numbers 1-5 represent different levels as do reference numbers 2 and 3 in FIG. 58. In FIG. 58 the floor separating levels 2 and 3 is represented by line 580*f*.

In FIG. 58, a top/bottom mounting extrusion 201 is mounted to the top of the wall on level 2 and a WDBR flashing extrusion 228 with a TB panel-batten extrusion 227 clipped thereto is mounted to the bottom of the wall on level 3.

It should also be appreciated however that the stack joint described in Example 3 and depicted in FIG. 51 can also be used every second level as there is no requirement for the joint in FIG. 51 to be used every level.

Figure 60:
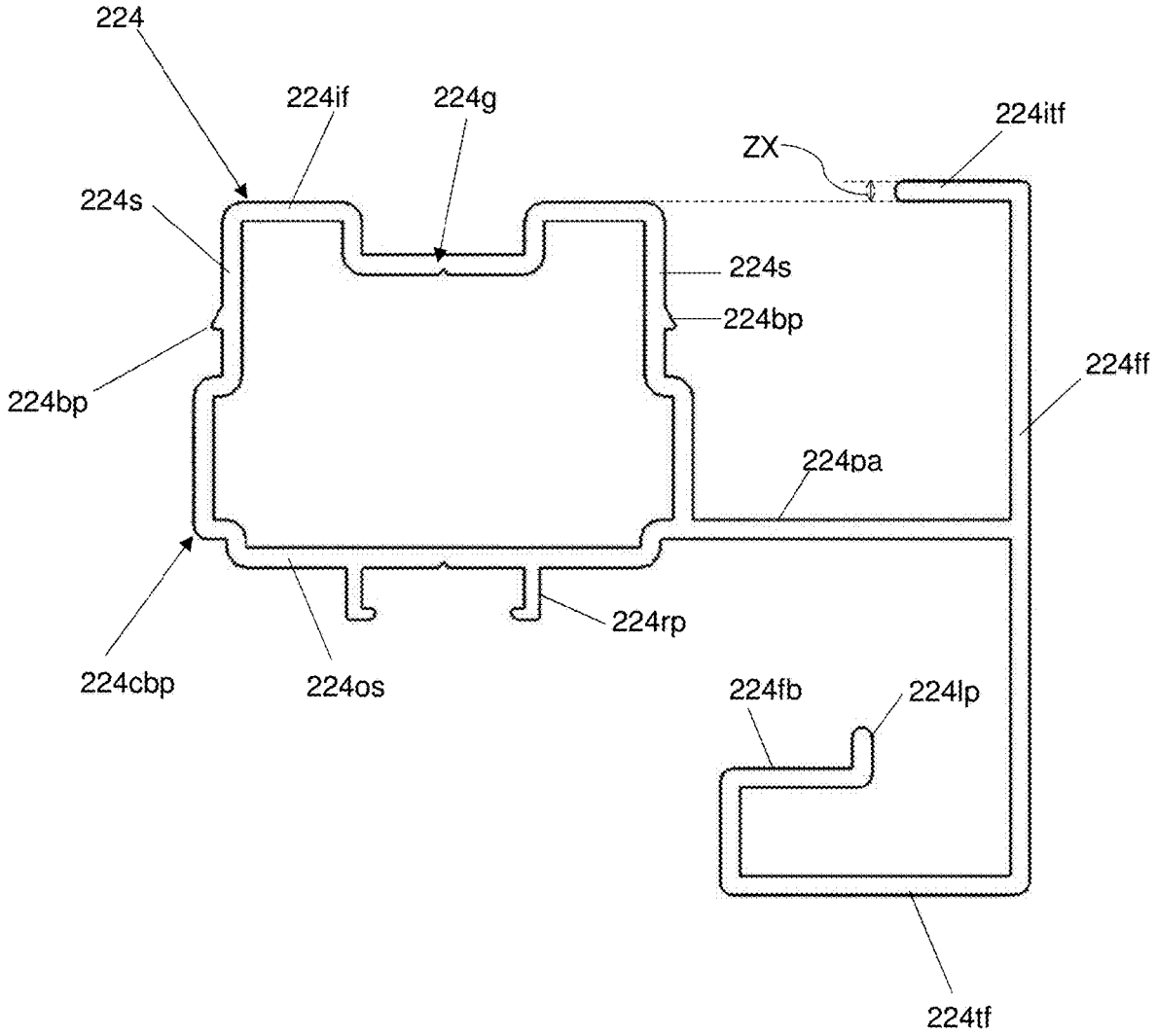
FIG. 60 shows an end on view of a transition batten extrusion in accordance with one preferred embodiment of the present invention.

Example 6—Best Modes Exemplars—Transition Batten for Use on Non-Finned Joinery on Commercial Buildings With respect to FIG. 60 there is shown a transition batten extrusion 224 which has a polygonal cavity batten portion 224*cbp* which is in the form of a substantially rectangular hollow section having an outward facing surface 224*os* which includes a receiving portion 224*rp* thereon. The cavity batten portion 224*cbp* has a projecting arm 224*pa* extending from the bottom corner of the outward facing surface 224*os*. At the distal end of the projecting arm 224*pa* is a fixing face 224*ff* which extends substantially parallel to side walls 224*s* of the cavity batten portion 224*cbp* on either side of the outward facing surface 224*os*.

Extending from the lower distal end of the fixing face 224*ff* is an outer transition face 224*otf* which includes a fold back portion 224*fb* which extends parallel to said outer transition face 224*otf* and extends a distance sufficient to receive, in use, a resilient sealing member, said fold back portion 224*fb* ending in a lipped projection 2241*p* on which the resilient sealing strip 2200 can be placed—see FIG. 61.

Extending from an upper distal end of the fixing face 224*ff* is an inner transition face 224*itf* which in use abuts a rigid underlay or flexible building wrap, the fixing face extending a distance T beyond an inner facing surface of the batten which is the same as the thickness of the base portion 211*b* of a vertical base extrusion 211 which secures the transition batten to the building frame—see FIGS. 60, 61.

The batten portion 224*cbp* has parallel sides 224*s* which each have barbed protrusions 224*bp* which are substantially triangular and configured to deform and then be retained by corresponding barbed protrusions 211*bp* on the projections 211*rp* on the vertical base extrusion 211—see FIG. 61.

FIG. 61 shows a transition batten extrusion 224 in use next to a commercial window frame/door frame 610. Like reference numerals as used in FIG. 60 indicate the key features of the transition batten extrusion shown in FIG. 61.

The transition batten extrusion 224 is held to the wall framing 610*w* via is clipped into the receiving portion of vertical base extrusion 211 which itself is affixed to wall framing 610*w* by screw 610*s*. In between the vertical base extrusion 211 and the wall framing 610*w* is a rigid air barrier 610*rb*.

The door/window frame 610 is also held to the wall frame 610*w* via screws 610*s* together with sealant 610*sl*.

A capping extrusion 202 is clipped in to the receiving portion 224*rp* and provides surface against which a panel 2000 can abut. A resilient sealing strip 2200 is sandwiched between the lipped projection 2241*p* on the transition batten and the outer face of panel 2000 to help hold the panel securely in place against the capping extrusion 202. To make an aesthetic transition between the window frame and panel 2000 a Z flashing 601*z* is used to cover this boundary.

The wall framing 610*w* is internally covered with gypsum board liner 610*gb* and the internal boundary between the window/door frame is also covered with a right-angled Z flashing 610*rz*.

Figure 62:
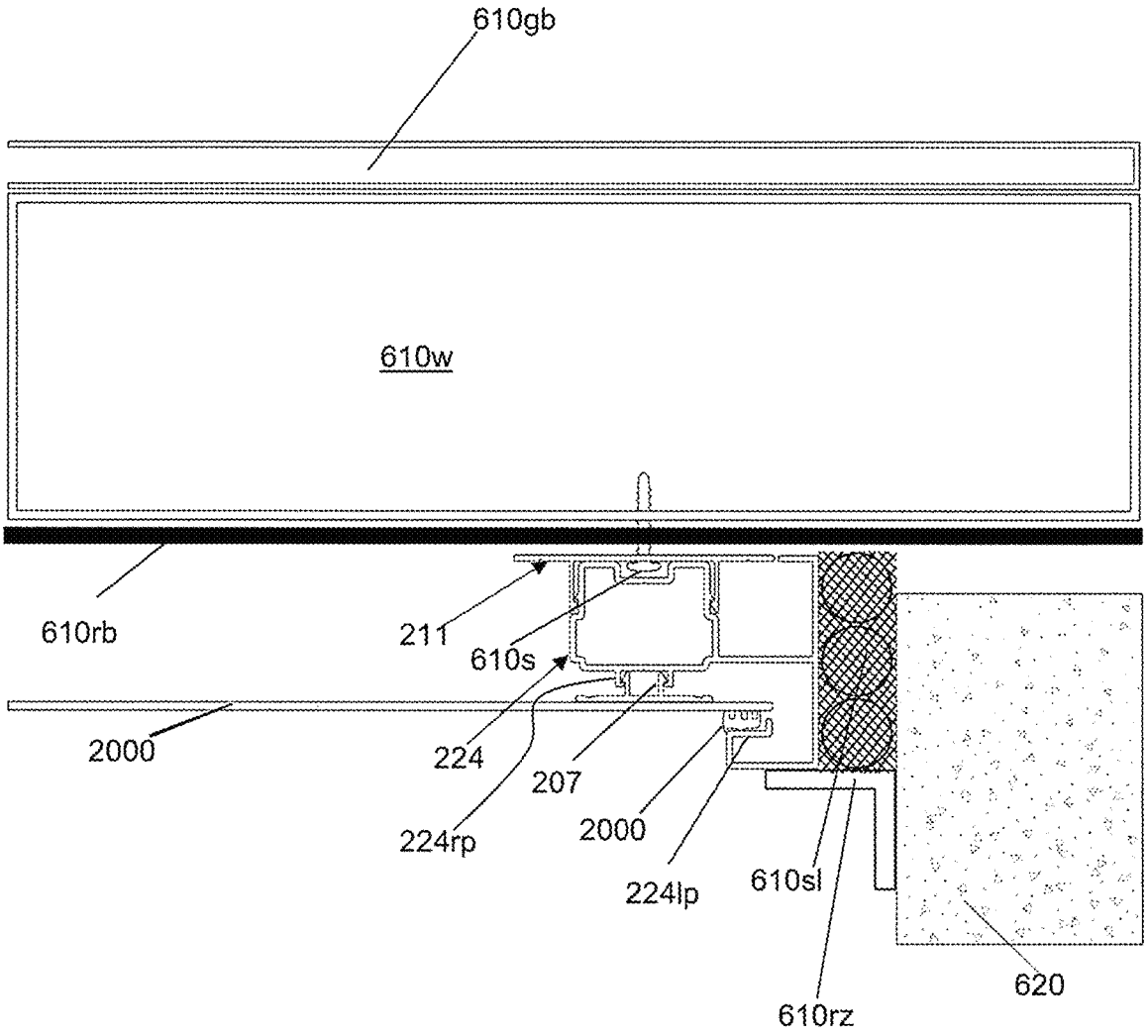
FIG. 62 shows a top schematic view of the transition batten extrusion in use transitioning between brick cladding and the aluminium panel exterior cladding of the present invention in a building which has more than one form of exterior cladding being utilized.

FIG. 62 is essentially the same as that shown in FIG. 61—so like reference numbers have been used to depict like elements. The key differences of FIG. 61 to FIG. 60 are that there is cladding in the form of bricks 620 against which the panel 2000 has to transition in place of the door/window frame 610. In addition, a right-angled Z flashing 620*z* has been used in place of the planar Z flashing shown in FIG. 61.

DISCUSSION OF INVENTION AND EXAMPLES OF ALTERNATE WAYS TO IMPLEMENT

The following discussion and examples provided herein are illustrative in nature and are not necessarily intended to limit the scope of the present invention(s) and inventive concept(s) embodied therein.

The sheet material for the panel may be made from a number of different materials suitable for cladding the exterior of a building and may have different shapes and sizes.

For example, the sheet material of the panel may be made from one or more of the following materials:

glass;
ceramics;
wood including plywood;
cement board;
metal;
alloy.

However, the above list of materials from which the panel may be made should not be seen as exhaustive, as other materials suitable for making panels for cladding the exterior of buildings may also be employed.

In a preferred embodiment, the panel may be made of aluminium. Preferably, a colour coated aluminium.

The mounting extrusions may come in a variety of different forms without departing from the scope of the present invention.

The mounting extrusions have a base portion and a receiving portion.

The base portion may be substantially planar in nature at least on the outer surface against which the panel will rest.

The receiving portion may have any number of configurations which enable push fit connection to the attachment portion on the capping extrusion.

The receiving portions on the mounting extrusions may be in the form of a longitudinally extending channel adapted to receive and retain attachment portions in the form of longitudinally extending/positioned pair or pairs of opposed projections on the capping extrusions.

The distance XC (see FIG. 29) by which the opposed projections forming a pair are spaced apart on the capping extrusions may be a distance smaller than the width YM (see FIG. 31)_of the channels into which they are placed on the mounting extrusions yet still sufficiently wide to frictionally engage with the walls of the channel on the mounting extrusions—thereby creating a clip fit.

It will be appreciated that the attachment portions may also be in the form of a longitudinal channels on the capping extrusions and the aforementioned projections may instead be on the mounting extrusions. Thus, it will be appreciated that the walls of a channel may also be considered a pair of projections.

In use, the mounting extrusions may be placed on the building frame such that the receiving portion, visibly surrounds the outer edges of the panel section to be retained by said panel mounting extrusion. This ensures the capping extrusions can access the receiving portion to thereby clip onto the mounting extrusion.

In preferred embodiments the pairs of projections on the receiving portion and attachment portion may made of an at least partially resilient material and may engage one another upon initial contact with the opposite pair the contact (i.e. distal) ends of each pair being shaped to cause temporary deformation of the projections and/or channels as they are pushed together; and the respective pairs then subsequently engage one another upon returning to their original non-deformed state in a manner which holds them together. The manner of holding them together may vary without departing from the scope of the present invention. It may be frictional or it may be due to a physical feature such as a shoulder.

In one embodiment, the engagement of the receiving and attachment portions may occur by the two portions fitting tightly together upon being pressed to clip to one another.

The channels may be adapted in a number of ways which can include one or more of:

the channels being at least partially deformable;
the channels having tapered surfaces on the upper edges thereof which can engage with tapered edges on the projections to deform the projections and/or channels and the channels/projections also having shoulders at the base (i.e. proximal end) of each taper edge which can catch the corresponding shoulder to hold the projections within said channel.

The term 'corner extrusions' includes both internal and external corner mounting extrusions.

The capping extrusions may come in a number of different forms without departing from the scope of the present invention.

In preferred embodiments, the capping extrusions may have a cover-section and an attachment portion.

The cover section may be a substantially planar at least on the inner surface on which the attachment portion is located and against which, in use, the outer surface of the panel will be adjacent.

The attachment portion may have any number of configurations which enable push clip fit connection to the receiving portion on the mounting extrusion. Some examples of suitable push clip fit connections are discussed above in relation mounting extrusions.

The distance that the respective vertical and horizontal mounting extrusions are spaced apart is determined by the dimensions of the panel.

For example, if a panel has a width of 2.4 m the vertical mounting extrusions may be spaced 2.4 m, provided the width of the panel is reduced by 3 mm. This trimming of the panel ensures:

there is the requisite overlap with the edge of the panel; and also ensures
the receiving portion on each vertical extrusion surrounds (i.e. frames) an outer vertical edge of the panel; and
allows for expansion of the panel.

The horizontal mounting extrusions are spaced apart in the same manner taking into account the height of the panel.

The resilient sealing strips may come in a variety of different forms and be made from various water impervious materials without departing from the scope of the present invention.

In general, the resilient sealing strips may have a substantially wedge shaped cross-sectional profile.

In one preferred embodiment, the resilient sealing strips may be made from rubber.

In another embodiment, the resilient sealing strips may be made from silicon.

In one preferred embodiment, the resilient sealing strips may be made from Thermoplastic elastomer. For example, the resilient sealing strip may be made from TPE Santoprene™ The cavity battens may come in a number of different forms without departing from the scope of the present invention.

In some embodiments, the cavity batten may have a substantially rectangular cross-sectional profile.

In other embodiments, the cavity batten may have substantially truncated V-shape with flanged ends.

In preferred embodiments, the cavity batten may include a receiving portion the same or similar to that discussed above for the mounting extrusion for securing a capping extrusion or other element thereto by means of a push clip fit.

In some embodiments, the cavity batten may integrally form part of a vertical mounting extrusions.

In some preferred embodiments, the cavity batten may be screwed directly into the stud.

In other embodiments, the cavity batten may clip fit into a vertical mounting extrusion—i.e. not require the use of fasteners.

In some preferred embodiments, the cavity batten adjacent a door/window may be connected to a stud via a vertical mounting extrusion which may have a channel into which the cavity batten is configured to clip fit. The vertical mounting extrusion being nailed or preferably screwed into the stud.

The spacer elements may be made from many materials and generally have a rectangular block form. The purpose of the spacer is to hold the bottom edge of the panel off the mounting extrusion and to enable the panel to expand and contract with substantially less friction then would occur if the panel was to rest on the mounting extrusion.

In a preferred embodiment, the spacer is made from a solid plastic block.

Most, preferably the spacer is made from a material having a low friction coefficient to enable the panel to undergo thermal expansion and contraction with minimal frictional engagement with the spacer.

The support (WANZ) bar extrusion and associated sill cap extrusion may be those that are readily available on the market in relation to aluminium joinery.

The top window flashing extrusions may be those readily available on the market in relation to aluminium joinery.

The present invention also encompasses cladding a two or multi-storey building. The components and methodology used for cladding the additional levels may be substantially the same as outlined for new builds and retrofits as per Example 1 and 2 above. The additional requirement for adding a level above an existing wall is the requirement for:

- a stack joint flashing extrusion 223 located above and overlapping with a portion of a top/bottom mounting extrusion on the top edge of a wall; and
- an additional top/bottom mounting extrusion located above and overlapping with a portion of the stack joint flashing.

Any one or more receiving portion may form a male connector half and any one or more attachment portion may form a corresponding female connector half. Alternatively, any one or more receiving portion may form a female connector half and any one or more attachment portion may form a corresponding male connector half. The receiving and attachment portions provide connector halves that can clip together to attach one extrusion to another extrusion.

The panel mounting extrusions 201, 203, 205, 207, 208 preferably contact an inside surface of the panel. In the illustrated embodiments the panel mounting extrusions comprise support legs L with a distal end of the legs L contacting the inner face of the panels adjacent an edge of the panels. The panel mounting extrusions may include one or more panel contacting legs L. A pair of legs may be provided, to receive a resilient member and/or adhesive therebetween.

In the preferred embodiment the system includes a base extrusion 211 to receive batten extrusions 210, 209 and panel mounting extrusion 207 with integral batten. However, in alternative embodiments the cavity battens 209, 210, and panel mounting extrusion 207 may include an integrally formed base to attach the extrusion 207, 209, 210 directly to the wall. Having a separate base extrusion 211 is preferred as installation is simplified since the same extrusion is used in vertical lengths spaced apart across the building. Once installed the appropriate extrusion 207, 209, 210 may be clipped into place on the wall.

The invention may also be said broadly to consist in the parts, elements and features referred to or indicated in the specification of the application, individually or collectively, in any or all combinations of two or more of said parts, elements or features.

Aspects of the present invention have been described by way of example only and it should be appreciated that modifications and additions may be made thereto without departing from the scope thereof as defined in the appended claims.

The invention claimed is:

1. An external cladding system for a wall of a building which includes:

(a) at least one panel of sheet material;

(b) a series of vertically and horizontally oriented panel mounting extrusions, the respective vertically and horizontally oriented panel mounting extrusions being spaced apart at sufficient distances to underlap with a portion of the at least one panel of sheet material and to surround at least two edges of a panel via at least receiving portions on said vertically and horizontally oriented panel mounting extrusions;

wherein said vertically and horizontally oriented panel mounting extrusions are configured to be affixed to a building frame via cavity battens;

(c) a plurality of spaced apart apertures passing through a topmost horizontal panel mounting extrusion and a bottom most horizontal panel mounting extrusion on the wall, the apertures extending along a longitudinal axis of an internal horizontal portion of said topmost and bottom most panel mounting extrusions;

wherein the at least one panel is configured to be held in place on said panel mounting extrusions, via a combination of:

(d) capping extrusions, which include attachment portions that engage with the receiving portion in the panel mounting extrusions, wherein the capping extrusion also includes a cover section, which overlaps with a portion of, and surrounds, at least two edges of the at least one panel;

(e) resilient sealing strips, which are located between the at least one panel and the capping extrusions; and (f) one or more spacer elements located on the horizontally oriented panel mounting extrusions which support the bottom edge of the at least one panel, the bottom edge of the at least one panel resting on said spacer element(s);

such that the combination enables the panel to expand or contract, and move with respect to the capping extrusion without any contact therewith.

2. An external cladding system as claimed in claim 1 wherein the cladding system further includes:

(a) cavity batten extrusions, wherein said panel mounting extrusions are configured to be affixed to a building frame via the cavity batten extrusions;

(b) a support bar extrusion and associated sill cap extrusion for affixing at the bottom of any windows/doors;

(c) top window flashing extrusions for affixing at the top of any windows/doors;

(d) top and bottom mounting extrusions to install over the top window/door flashing.

3. An external cladding system as claimed in claim 1, wherein one or more said panel mounting extrusions is integrated as a whole with said cavity batten.

4. An external cladding system as claimed in claim 1, further comprising spacer extrusions, wherein the horizontal panel mounting extrusions are attached to spaced apart vertical cavity battens, and wherein a said spacer extrusion is attached to vertical cavity battens between adjacent horizontal panel mounting extrusions intermediate vertical edges of the panels, wherein the spacer extrusion bears against an inside surface of the panels.

5. An external cladding system as claimed in claim 4, wherein the spacer extrusion has the same cross section as the capping extrusion.

6. An external cladding system as claimed in claim 1, wherein the system further comprises a mounting extrusion in the form of a vertical cavity batten extrusion to be positioned adjacent a window or door frame, wherein the vertical cavity batten extrusion comprises an integral weather flashing.

7. An external cladding system as claimed in claim 1, wherein a said panel mounting extrusion comprises one or more integral weather flashings.

8. An external cladding system as claimed in claim 1, wherein securement of the panel between the mounting extrusion and capping extrusion takes place without the use of fasteners.

9. A method of cladding a wall of a building with one or more panels comprising the steps of:

a) affixing a series of vertically and horizontally oriented panel mounting extrusions, spaced apart a sufficient distance, to underlap with a portion of, and surround, via at least a receiving portion on said mounting extrusion, at least two edges of a panel; said panel mounting extrusions are affixed to a building frame via cavity battens;

b) placing one or more spacer elements located on the horizontally oriented panel mounting extrusions which support the bottom edge of a panel, the bottom edge of a panel resting on said spacer element(s);

c) securing the panel(s) in place on said extrusions, via a combination of:

capping extrusions which include attachment portions which engage with receiving portions in the panel mounting extrusions wherein the capping elements overlaps with a portion of, and surround, at least two edges of the panels; and resilient sealing strips which are squeezed between the panel and the capping extrusions;

such that the panel can, expand or contract, with respect to the capping extrusion without any contact therewith; wherein the uppermost and lowermost horizontally oriented panel mounting extrusions on the wall associated with a level of the building are configured to allow air to pass from the exterior to the interior of the panels.

* * * * *